US006263815B1

(12) United States Patent
Furudate

(10) Patent No.: US 6,263,815 B1
(45) Date of Patent: Jul. 24, 2001

(54) SEWING SYSTEM AND SEWING METHOD

(75) Inventor: Hiroshi Furudate, Fukushima (JP)

(73) Assignees: Yoshiko Hashimoto; Akira Furudate, both of Fukushima (JP)

( * ) Notice: Subject to any disclaimer, the term of this patent is extended or adjusted under 35 U.S.C. 154(b) by 0 days.

(21) Appl. No.: 09/398,163

(22) Filed: Sep. 17, 1999

(51) Int. Cl.[7] ..... D05B 21/00
(52) U.S. Cl. ..... 112/470.13; 112/475.02
(58) Field of Search ..... 112/470.12, 470.13, 112/470.01, 470.03, 470.06, 470.07, 102.5, 475.01, 475.02, 475.03, 475.04, 475.05, 475.19, 470.31; 66/1 R

(56) References Cited

U.S. PATENT DOCUMENTS 4,846,085 * 7/1989 Ishibashi et al. ..... 112/475.05 X
5,027,726 * 7/1991 Brower et al. ..... 112/470.12 X

FOREIGN PATENT DOCUMENTS 52-125052 10/1977 (JP) .

* cited by examiner

*Primary Examiner*—Peter Nerbun
(74) *Attorney, Agent, or Firm*—Knoble & Yoshida LLC

(57) ABSTRACT

A sewing system which can properly arrange stitch loops in a sewn section by automatically stitching knitted pieces with each other without requiring the exchange of a main sewing machine body in accordance with the coarseness and fineness of the stitches and is also suitable for stitching a knitted piece with a fabric. The sewing system (10) is provided with the main sewing machine body (14) equipped with a setting table (15) for fixing objects (21*a* and 21*b*) to be sewn, a sewing needle (18), a sewing machine bed (12), and a first servo motor (29) which moves the needle (18) upward and downward , an X–Y table (44) equipped with first and second servo motors (45*c* and 46*c*) for moving the main body (14) forward and backward in the X–Y direction, a CCD camera (22) which fetches the picture data on the surface of the object (21*b*), a memory (56) which stores picture data of the pattern of marks arranged on the surface of the object (21*b*), and a controller (55) which calculates the coordinates of stitches (α) to be sewn by the needle (18) by comparing picture data and which commands the main body (14) to sew the stitches (α) by moving the main body (14).

26 Claims, 31 Drawing Sheets

SEWING SYSTEM AND SEWING METHOD

TECHNICAL FIELD

This invention relates to a sewing system and a sewing method, and more particularly to a sewing system and a sewing method which are suitable for sewing a knitted fabric (knitted goods) having stitches and a high expansibility and a stitchless woven fabric having a low expansibility together, and knitted fabrics together.

BACKGROUND OF THE INVENTION

A knitted fabric is manufactured by knitting yarn by a knitting needle or a knitting stick, and it therefore has a texture in which a plurality of stitches are continuously intertwined with each other, and a high expansibility. In order to manufacture a knitted product, for example, a sweater etc. by sewing such knitted fabrics, a single-purpose sewing machine (which will hereinafter be referred to as "linking sewing machine") is used. As shown in FIG. 36, this linking sewing machine 80 is provided with a throat plate 82 on which a plurality of locking needles 81 are arranged at predetermined intervals similarly to the teeth of a comb.

Each of the locking needles 81 has a shape of the letter "L", and is provided with a locking portion 81*a* and a fixed portion 81*b* as shown in FIG. 37, the fixed portion 81*b* being fastened to a lower surface of the throat plate 82 by welding etc. The locking portion 81*a* is sharp edged at a free end section thereof, and provided with a guide groove 81*c* in a front surface thereof.

As shown in FIG. 38, loops (stitches) 83*a* of one knitted fabric 83 are fitted forcibly in order around the locking needles 81 on the throat plate 82 with loops 84*a* of the other knitted fabric 84 fitted forcibly in order therearound from the opposite side, a sewing needle 85 being then moved up and down to sew up the loops 83*a,* 84*a* of the two knitted fabrics together.

When the sewing needle 85 moves down from an upper dead center toward a lower dead center, a tip of the needle advances along the guide groove 81*c* of the locking needle 81 to pass between the loops 83*a,* 84*a* of the two knitted fabrics. The sewing needle 85 then enters a space under a sewing machine bed 86 through a hole 86*a* formed therein, and a sewing thread inserted through a thread hole of a tip portion of the sewing needle is guided to a position close to a tip portion 87*a* of a wedge-shaped looper 87. The looper 87, which is rotated in a predetermined direction, captures the sewing thread at its tip portion 87*a* when the sewing needle 85 enters into an upward return stroke, to form a loop, which is retained until the sewing needle 85 has thereafter moved down to the same position, the sewing thread being then passed through this loop to form a chain-like seam, whereby the sewing of the two knitted fabrics 83, 84 is attained.

The throat plate 82 is engaged with a table 88 of a comparatively large length disposed on the front side of the sewing machine bed 86 and extending so as to cross a sewing machine body at right angles thereto. A guide rail 89 is fixed (FIG. 37) to a lower surface of the throat plate 82, and fitted in a guide groove 88*a* formed in the table 88, so that the throat plate 82 is rendered laterally slidable on the table 88.

A feed gear 90 is provided below the throat plate 82, and meshed with the fixed portions 81*b,* which are arranged in the form of a rack on the lower surface of the throat plate 82, of the locking needles 81. This feed gear 90 is connected to a driving power source for the sewing needle 85 via transmission means, such as another gear 91 and a belt (not shown), and adapted to be rotated synchronously with the vertical movements of the sewing needle 85. Namely, each time the sewing needle 85 makes one upward and downward travel, the throat plate 82 slides by a distance corresponding to a distance between two adjacent fixed portions 81*b,* and a subsequent locking needle 81 moves to a position just under the sewing needle 85. The looper 87 is also connected to the above-mentioned driving power source via a transmission mechanism (not shown), and adapted to make one full turn synchronously with one upward and downward travel of the sewing needle 85.

Thus, the two knitted fabrics 83, 84 can be sewed together by forming a chain-like seam, so that a predetermined expansibility can be secured in the sewn portions of the knitted fabrics. Accordingly, the linking sewing machine can be adapted excellently to the property of knitted products having an expansibility. Since the sewing operation is carried out by carefully thrusting the locking needles 81 on the throat plate 82 into the loops 83*a,* 84*a* of the knitted fabrics, the loops are arranged beautifully on the sewn portion. This can not only improve the design effect but also effectively prevent the knitted fabrics from coming loose at terminal end portions thereof.

However, in order to beautifully arrange the stitch loops on the sewn portion as mentioned above, it is necessary that the locking needles 81 on the throat plate 82 be thrust into all the loops 83*a,* 84*a* in order without skipping any one of them, and this work is necessarily performed by manual operations of a skilled worker at present. Under the circumstances, even when the reduction of the sewing time is attempted by electrifying a driving means for the linking sewing machine 80, it takes time to set objects to be sewn on the throat plate 82, so that the improvement of an overall productivity by the sewing machine is greatly limited.

In a conventional linking sewing machine 80, it is necessary that a sewing machine body be replaced in accordance with the coarseness or density of the stitches of the knitted fabrics 83, 84, objects to be sewn. The coarseness or density of the knitted fabrics 83, 84 is determined by a gauge of the knitting machine, and the intervals of the locking needles 81 on the throat plate 82 are also regulated so as to match the same with the gauge. The timing of the upward and downward movements made by the sewing machine body of the sewing needle 85 and the intermittent feeding of the throat plate 82 is done fixedly in practice by selecting the kind and its combination of inside-provided gears. Therefore, in order to use a throat plate 82 matching the gauge of changed knitted fabrics 83, 84, the sewing machine body has to be replaced by a sewing machine body provided with a single-purpose gear structure specially adapted to this gauge, and this constitutes a large load on the improving of a labor effectiveness and a desire to make plant and equipment investment.

In order to obtain an article of clothing of certain function and design, the necessity of sewing a knitted fabric having a high expansibility and a woven fabric having a low expansibility together may arise. When the linking sewing machine 80 is used in such a case, stitches can be captured by the locking needles 81. This enables loops to be arranged on a sewn portion, and the characteristics of the knitted fabrics to be effectively utilized. However, when a woven fabric having a low expansibility is sewn so as to form a chain-sewn fabric having an expansibility, a lot of fine wrinkles occur on the woven fabric, so that using for this purpose a linking sewing machine made solely for knitted fabrics is not suitable.

Therefore, the sewing of a knitted fabric and a woven fabric together has heretofore been done by a lock stitch sewing machine which is used to sew woven fabrics together. Unlike a linking sewing machine in which fabrics are sewn together with one yarn to form a chain-sewn fabric, the lock stitch sewing machine is adapted to combine upper and lower yarn with each other, so that a rigid and non-expansible seam is formed.

When a lock stitch sewing machine is thus used, a dense and strong seam is certainly formed owing to the intertwined upper and lower yarn, and fine wrinkles do not therefore occur on the woven fabric. However, the lock stitch sewing machine does not, of course, have locking needles, and cannot sew knitted fabrics by carefully picking up the stitches thereof. Therefore, the loops of the knitted fabrics cannot be beautifully arranged, and they cannot be utilized effectively for the designing of the resultant sewn product. Moreover, there is the possibility that the yarn becomes loose at a terminal end portion of the sewn fabrics.

When a knitted fabric 83 and a woven fabric 92 are sewn together by conventional techniques by a lock stitch sewing machine as shown in FIG. 39, the lock stitch sewing operation is necessarily carried out with the portion of the knitted fabric 83 which is in the vicinity of a terminal end thereof put in a folded condition. Even when the terminal end portion of the fabrics thus sewn becomes loose, the loosened portion is stopped at a seam 93, so that the spoiling of an outer surface of the knitted fabric 83 can be prevented.

However, since the knitted fabric 83 which is thick by itself is folded, the thickness thereof increases twice, and the sewn portion is formed as if it were patchwork, this preventing the knitted fabric from being united naturally with the woven fabric 92. Consequently, the designs of articles of clothing are greatly restricted.

The present invention has been worked out with a view to solving these problems encountered in the conventional techniques of this kind, and aims at obtaining a means for sewing the stitches of knitted fabrics reliably even when these stitches are not set one by one accurately on locking needles, and arranging beautiful loops of stitches in good order on a sewn portion.

The present invention also aims at providing an ideal sewing means which enables one sewing machine body to deal with all types of stitches without replacing the sewing machine body by a single-purpose sewing machine body in accordance with the coarseness or density of the stitches of knitted fabrics.

The present invention further aims at providing a sewing means which does not have the possibility, even when a terminal end portion of a knitted fabric is not folded, that a knitted fabric and a woven fabric that are sewn together become loose, and which does not cause fine wrinkles to occur on the woven fabric.

SUMMARY OF THE INVENTION

To achieve these objects, the sewing system according to the present invention comprises at least one table for placing objects to be sewn thereon; a sewing machine body which has a sewing needle provided so that it can be moved up and down freely, and a motor for moving the sewing needle up and down at an arbitrary speed, and which is adapted to sew the objects together; an X–Y feed mechanism adapted to move the sewing machine body relatively by a required amount in the direction parallel to the axis of the table, and also move the same relatively by a required amount in the direction perpendicular to the axis of the table; an image sensor adapted to fetch image data on the objects to be sewn; a storage means adapted to store therein a shape of guide patterns provided on the objects to be sewn and indicative of portions to be sewn together, and a position, which is set on the basis of the guide patterns, of the portions to be sewn together; and a control means adapted to search the image data, which are fetched sequentially by the image sensor, for the shape of the guide patterns stored in the storage means, compute in order on the basis of the detected guide patterns the coordinates on which the portions to be sewn are positioned, compute a difference between the resultant coordinates and coordinates on which the sewing needle of the sewing machine body is actually placed, move the sewing machine body on the basis of this computation result by a required amount in a required direction, and give instructions to execute the sewing of the portions indicated by the guide patterns.

The objects to be sewn include not only woven fabrics of cotton, silk, wool and synthetic fiber besides knitted fabrics but also all other materials, such as synthetic leather and natural leather.

This sewing system is formed so as to compute the coordinates on which portions to be sewn are positioned, by comparing with each other image data, which have been stored in advance in the storage means, on a guide pattern indicative of the portions to be sewn and image data, which are fetched from the image sensor, on the surfaces of the objects to be sewn, move the sewing machine body to a sewing operation executable position on the basis of the computation result, and automatically sew the object portions. Therefore, when the sewing system is operated so that knitted fabrics are selected as objects to be sewn with stitches to be sewn specified by the guide patterns, it becomes possible to beautifully arrange loops of stitches on the portions to be sewn, without carrying out the steps, which are included in a conventional sewing system of this kind, of finding out stitches of knitted fabrics by the naked eyes, and engaging the stitches one by one with the locking needles, and to attain a great increase in the efficiency of the sewing operation.

The amount of movement per unit time of the sewing machine body and the timing of the upward and downward movements of the sewing needle can be controlled freely as necessary, so that the sewing of knitted fabrics having stitches of all levels of intervals can be done by a single sewing machine body without requiring the operation included in a conventional sewing system for replacing the sewing machine body each time the intervals of stitches of object knitted fabrics are changed.

The sewing machine body in the present invention is capable of relatively varying the positional relation between this sewing machine body and the table on which the object to be sewn is placed, by the X–Y feed mechanism. This capability of the X–Y feed mechanism is applicable to not only a case where the sewing machine body is moved thereby but also a case where the table is moved with the sewing machine body left fixed, and a case where both the sewing machine body and table are moved together. Since the provision of the X–Y feed mechanism aims at correcting a deviation from each other of the position of the sewing needle of the sewing machine body and that of the portions to be sewn, the same results are obtained either when the sewing machine body is moved, or when the table is moved.

The guide pattern is formed by knitting waste yarn into the surfaces of the knitted fabrics as objects to be sewn, in such a manner that stitches of a predetermined shape are arranged continuously.

The guide patterns may also be formed by displaying figures of a predetermined shape on the portion of the plate which is in the vicinity of the surfaces of the objects to be sewn, in such a manner that the figures are arranged continuously at predetermined intervals.

The sewing machine body desirably comprises a sewing machine body provided with a shuttle having a tip and a bobbin thread stored therein. The shuttle is adapted to be rotated synchronously with the upward and downward movements of the sewing needle, capture at the tip thereof a needle thread carried by the sewing needle, and form a seam of lock stitches by connecting the bobbin thread to the needle thread.

When a so-called lock stitch sewing machine is used even for sewing a knitted fabric and woven fabric together, fine wrinkles do not occur on the woven fabric, and the loops on the knitted fabric are beautifully arranged. Therefore, there is no possibility that the yarn of the terminal end portion of the knitted fabric becomes loose, even when the terminal end portion is not folded.

A sewing machine body provided with a tip-carrying looper may, of course, be used as the sewing machine body. The looper is adapted to be rotated synchronously with the upward and downward movements of the sewing needle, capture at the tip thereof a sewing thread carried by the sewing needle and form loops, and form a chain type seam by passing the sewing thread, which has subsequently been carried by the sewing needle, through the loops.

It is desirable that a means for fixing the objects to be sewn on the table be provided. A means corresponding to this fixing means comprises, for example, a fixing needle throat plate provided in the interior of the table and having a plurality of fixing needles, and a pressure member disposed on an outer portion of the table and having a recess for housing the fixing needles therein, the objects to be sewn being fixed on an upper surface of said table by moving up said throat plate so as to project said fixing needles from the surface of said table so that said fixing needles can be thrust into the objects to be sewn, and moving said pressure member to the upper surface of said table so as to store said fixing needles in said recess, and press the upper surfaces of the objects to be sewn, the objects to be sewn being removed from said table by lowering said throat plate so as to retract said fixing needles into the lower surface of said table, and moving said pressure member in the opposite direction of the surface of said table so as to release the object.

It is desirable that, on the fixing needle throat plate, groups in each of which a plurality of fixing needles of a comparatively large length are arranged and groups in each of which a plurality of fixing needles of a comparatively small length are arranged are provided alternately.

The purpose of providing the fixing means is to merely hold the objects to be sewn, in such a manner that the objects do not move during a sewing operation carried out by the sewing machine body. Therefore, it is unnecessary that the loops of stitches be arranged accurately when the objects are fixed.

The table may be provided with a stretch-fixing means for fixing in a stretched state objects to be sewn having an expansibility, and a stabilization means for preventing the fixed objects from being dislocated while they are sewn.

A means corresponding to this stretch-fixing means comprises, for example, a stationary fixing member provided with a locking needle capable of being hung on one end portion of the objects to be sewn, and a movable fixing member provided with a locking needle capable of being hung on the other end portion of the objects; disposed movably in the stretching direction; and capable of being fixed in a required position.

For example, a fixable plate having a surface adhesiveness and provided detachably on the surface of a table corresponds to the stabilization means. A stabilization means comprising a plurality of suction ports formed in a surface plate of a table, and a suction unit joined in a communicating state to the suction ports may also be used.

The table is desirably provided with a holding member for pressing the outer surface of objects to be sewn which has been stretched to a required length by the stretch-fixing means.

The table may also be provided on its surface with a measuring member for determining the length of the objects to be sewn.

The table may be formed so that it comprises a first table member provided with a stretch-fixing means and a stabilization means, and a second table member provided with a fixing means comprising a fixing needle throat plate and a holding member. In this case, a needle path through which a sewing needle of a sewing machine body passes is formed between said table members.

The sewing method according to the present invention is characterized in that it includes at least the steps of forming guide patterns indicative of stitches to be sewn, by knitting waste thread into the surface of a knitted fabric, one object to be sewn, in such a manner that stitches of a predetermined shape are arranged continuously; placing on a surface of the table the other object to be sewn, and laminating the knitted fabric on the second-mentioned object to be sewn; fetching an image of the surface of this knitted fabric by using an image sensor; setting the shape of the guide patterns, which are to be detected, on the basis of the image, setting a position of stitches, which are to be sewn together, on the basis of the guide patterns, and storing these set results in a storage means; scanning the surface of the knitted fabric by the image sensor and fetching image data sequentially; searching the image data for the shape of the guide patterns stored in the storage means, and sequentially computing coordinates on which the stitches to be sewn together are positioned, on the basis of the detected guide patterns; and aligning a sewing needle of a sewing machine and the stitches to be sewn with each other, on the basis of the computation results, and sequentially executing the sewing of the stitches.

When both of the objects to be sewn are knitted fabrics, the sewing method is desirably constituted so that it includes at least the steps of knitting waste threads into the surfaces of a first knitted fabric, one object to be sewn, and a second knitted fabric, the other object to be sewn, in such a manner that stitches of a predetermined shape are continuously arranged, and thereby forming guide patterns indicative of stitches to be sewn; placing the first knitted fabric on the surface of a table; fetching an image of the surface of the first knitted fabric by using an image sensor; setting a shape of the guide patterns to be detected, on the basis of the image, setting positions of the stitches to be sewn, on the basis of the guide patterns, and storing these set results in a storage means; scanning the surface of the first knitted fabric by the image sensor, and sequentially fetching image data; searching the image data for the shape of the guide pattern stored in the storage means, and sequentially computing coordinates on which the stitches to be sewn are positioned, on the basis of the detected guide pattern; aligning with each other a sewing needle of a sewing machine and the stitches to be sewn, on the basis of the computation results, and sequentially executing the back tuck sewing of the stitches; laminating the second knitted fabric on the surface of the first knitted fabric; scanning the surface of the second knitted fabric by the image sensor, and fetching image data sequentially; searching the image data for the shape of the guide patterns stored in the storage means, and sequentially computing the coordinates on which the stitches to be sewn are positioned, on the basis of the position of the detected guide patterns; and aligning with each other the sewing needle of the sewing machine and the stitches to be sewn on the basis of the computation results, and sequentially executing the sewing of the stitches.

When the shape and pitch of figures of the guide patterns formed on the surface of the first knitted fabric and those of the guide patterns formed on the surface of the second knitted fabrics are different, it is necessary to alter the data set in the storage means.

Namely, the steps of fetching, before the sewing operation has been switched over to the sewing of the second knitted fabric, an image of the surface of the second knitted fabric by using the image sensor; and setting the shape of the guide pattern to be detected, on the basis of the image, setting the position of the stitches to be sewn, on the basis of the guide patterns, and storing these set results in the storage means again may be added.

In the case of a sewing method, wherein a part of one object to be sewn is inserted between first and second end parts of a knitted fabric, the other object to be sewn, to sew these parts together just as in, for example, a piping neck attaching operation, the method may be constituted so that it includes at least the steps of knitting waste threads into the surfaces of the first and second end parts so that stitches of a predetermined shape are arranged continuously, and thereby forming guide patterns indicative of the stitches to be sewn; placing on the surface of a table the first-mentioned object to be sewn, and laminating the first end part on one surface of the first-mentioned object to be sewn; fetching an image of the surface of the first end part by using an image sensor; setting the shape of the guide patterns to be detected, on the basis of the image, setting the position of the stitches to be sewn, on the basis of the guide patterns, and storing these set results in the storage means; scanning the surface of the first end part by the image sensor, and fetching image data sequentially; searching the image data for the shape of the guide patterns stored in the storage means, and sequentially computing coordinates on which the stitches to be sewn are positioned, on the basis of the position of the detected guide patterns; aligning a sewing needle of a sewing machine and the stitches to be sewn, with each other on the basis of the computation result, and sequentially executing the sewing of the stitches; reversing the first end part and the first-mentioned object to be sewn, and laminating the second end part on the other surface of the first-mentioned object to be sewn; scanning the surface of the second end part by the image sensor, and sequentially fetching image data; searching the image data for the shape of the guide patterns stored in the storage means, and sequentially computing the coordinates on which the stitches to be sewn are positioned, on the basis of the position of the detected guide patterns; and aligning with each other the sewing needle of the sewing machine and the stitches to be sewn on the basis of the computation results, and sequentially executing the sewing of the stitches.

In this method, the steps of fetching an image of the surface of the second end part by using the image sensor before the sewing operation has been switched over to the sewing of the second end part; and setting the shape of the guide patterns to be detected, on the basis of the image, setting the position of the stitches to be sewn, on the basis of the guide patterns, and storing these set results in the storage means again may, of course, be added.

This method may also be constituted so that it includes at least the steps of knitting waste threads into the surfaces of the first and second end parts so that stitches of a predetermined shape are arranged continuously, and thereby forming guide patterns indicative of the stitches to be sewn; placing the first end part on the surface of a table; fetching an image of the surface of the first end part by using an image sensor, setting the shape of guide patterns to be detected, on the basis of the image, setting the position of the stitches to be sewn, on the basis of the guide patterns, and storing these set results in the storage means; scanning the surface of the first end part by the image sensor, and fetching image data sequentially; searching the image data for the shape of the guide patterns stored in the storage means, and sequentially computing coordinates on which the stitches to be sewn are positioned, on the basis of the position of the detected guide patterns; aligning a sewing needle of a sewing machine and the stitches to be sewn, with each other on the basis of the computation result, and sequentially executing the back tuck sewing of the stitches; reversing the first end part, and laminating the first-mentioned object to be sewn and second end part thereon; scanning the surface of the second end part by the image sensor, and sequentially fetching image data; searching the image data for the shape of the guide patterns stored in the storage means, and sequentially computing the coordinates on which the stitches to be sewn are positioned, on the basis of the position of the detected guide patterns; and aligning with each other the sewing needle of the sewing machine and the stitches to be sewn, on the basis of the computation results, and sequentially executing the sewing of the stitches.

In this method, the steps of fetching an image of the surface of the second end part by using the image sensor before the sewing operation has been switched to the sewing of the second end part; and setting the shape of the guide pattern to be detected, on the basis of the image, setting the position of the stitches to be sewn, on the basis of the guide patterns, and storing the set results again in the storage means may also be added.

The aligning with each other of the sewing needle of the sewing machine and the stitches to be sewn is attained by, for example, moving at least one of the sewing machine and objects to be sewn, in at least one of the X-direction and Y-direction.

The guide patterns are formed by, for example, preparing waste thread by impregnating a thread of a color different from that of the yarn constituting the knitted fabric with a predetermined resin; and knitting this waste yarn into the portions of the knitted fabric which are in the vicinity of the stitches to be sewn.

In a typical case, a black waste thread is used when the object knitted fabric is white, and a white waste thread when the object knitted fabric is black. When the object knitted fabric is formed of color yarn (dyed yarn), the waste thread can also be formed of a raw (undyed) thread. In short, a thread of a color which enables the contour of waste threads to be recognized clearly by the image sensor may be selected.

A waste thread formed by impregnating a thread with a predetermined resin and fluorescent paint so that the resultant thread can be distinguished from the yarn constituting the knitted fabric may be knitted into the portions of the knitted fabric which are close to the stitches to be sewn, to form guide patterns. When such guide patterns are formed, the contours thereof can be displayed clearly by applying black light thereto.

It is desirable that the guide patterns be formed by subjecting a waste thread comprising chemical fiber or mixed fiber of chemical fiber and natural fiber to plain knitting.

The waste thread is desirably removed after the completion of the sewing of the object fabrics.

When the knitted fabric comprises a garment knitted portion having a stitch pattern proper to a knitted product, and a waste course knitted portion formed continuously from the garment knitted portion, the steps of forming guide patterns indicative of the stitches to be sewn, by knitting the waste thread into the part of the waste course knitted portion which is close to a part thereof bordering the garment knitted portion; and removing the waste course knitted portion with the waste thread after the completion of the sewing operation may be included.

The objects to be sewn may be fixed by engaging at least a part thereof with a plurality of fixing needles.

When a sewing line of the objects to be sewn is divided into a plurality of sections due to the existence of a curved section, it is desirable to divide a plurality of fixing needles, which are arranged at predetermined intervals, into a plurality of groups each of which has such a number of fixing needles that corresponds to the curvature and length of each section of the objects to be sewn, by setting a plurality of marks at predetermined intervals; and engaging, when the sewing line of the objects to be sewn is engaged with the fixing needles, each section of the objects with the fixing needles belonging to its corresponding group.

BRIEF DESCRIPTION OF THE DRAWINGS

FIG. 10 is an enlarged view showing the condition in which guide patterns are formed by knitting a waste thread into the knitted fabric;

FIG. 11 is an enlarged view showing the condition in which the guide pattern have been removed after the completion of the sewing of the knitted fabric;

FIG. 12 is an imaginary view showing the condition in which guide patterns formed by a waste thread impregnated with fluorescent paint and a resin is irradiated with black light;

FIG. 13 is a plan view showing the condition in which a waste thread is knitted into a waste course knitted portion of the knitted fabric;

FIG. 14 is a plan view showing the condition in which the waste course knitted portion has been removed with the waste thread after the completion of the sewing of the knitted fabric;

FIG. 15 is a plan view showing a process of sewing a sweater;

FIG. 16 is plan view showing a neck portion to be sewn on a turtleneck portion of the sweater;

FIG. 17 is a concept diagram showing a sewing line of a sweater;

FIG. 18 is a front view showing the condition in which marks are put on a fixing needle throat plate;

FIG. 19 is a schematic diagram illustrating a sewing method for the fixing of a piping neck;

FIG. 20 is a schematic diagram illustrating a sewing method for the fixing of a piping neck;

FIG. 21 is a plan view showing a seam formed after the completion of the piping neck fixing operation;

FIG. 22 is a schematic diagram illustrating another sewing method for the fixing of a piping neck;

FIG. 23 is a schematic diagram illustrating a method of sewing a pair of knitted fabrics together;

FIG. 24 is a plan view showing a seam formed after the completion of the sewing of the two knitted fabrics;

FIG. 25 is a plan view showing a plate displaying a plurality of guide patterns;

FIG. 26 is a schematic diagram showing an example of use of the plate;

FIG. 27 is a side view showing another example of a sewing machine body;

FIG. 28 is a side view showing a second sewing system according to the present invention;

FIG. 29 is a plan view showing this sewing system;

FIG. 30 is a plan view showing a stretch-fixing means of the sewing system;

FIG. 31 is a plan view showing a process for setting objects to be sewn on the sewing system;

FIG. 32 is a plan view showing a process for setting objects to be sewn on the sewing system;

FIG. 33 is a plan view showing a process for setting objects to be sewn on the sewing system;

FIG. 34 is a plan view showing a process for setting objects to be sewn on the sewing system;

FIG. 35 is a plan view showing a modified example of the second sewing system;

FIG. 36 is a partial front view of a throat plate, which is observed from the side of a sewing machine body, of a conventional sewing machine solely for knitted fabrics;

FIG. 37 is a partial sectional view showing a free end portion of a bed of the conventional sewing machine solely for knitted fabrics;

FIG. 38 is a schematic diagram showing the condition in which the locking needles of the conventional sewing machine solely for knitted fabrics are thrust through terminal end loops of a pair of knitted fabrics;

FIG. 39 is a side view showing the condition in which a knitted fabric and a woven fabric are sewn by a conventional lock stitch sewing machine.

PREFERRED EMBODIMENTS OF THE INVENTION

The sewing systems according to the present invention will now be described with reference to the accompanying drawings.

Figure 1:
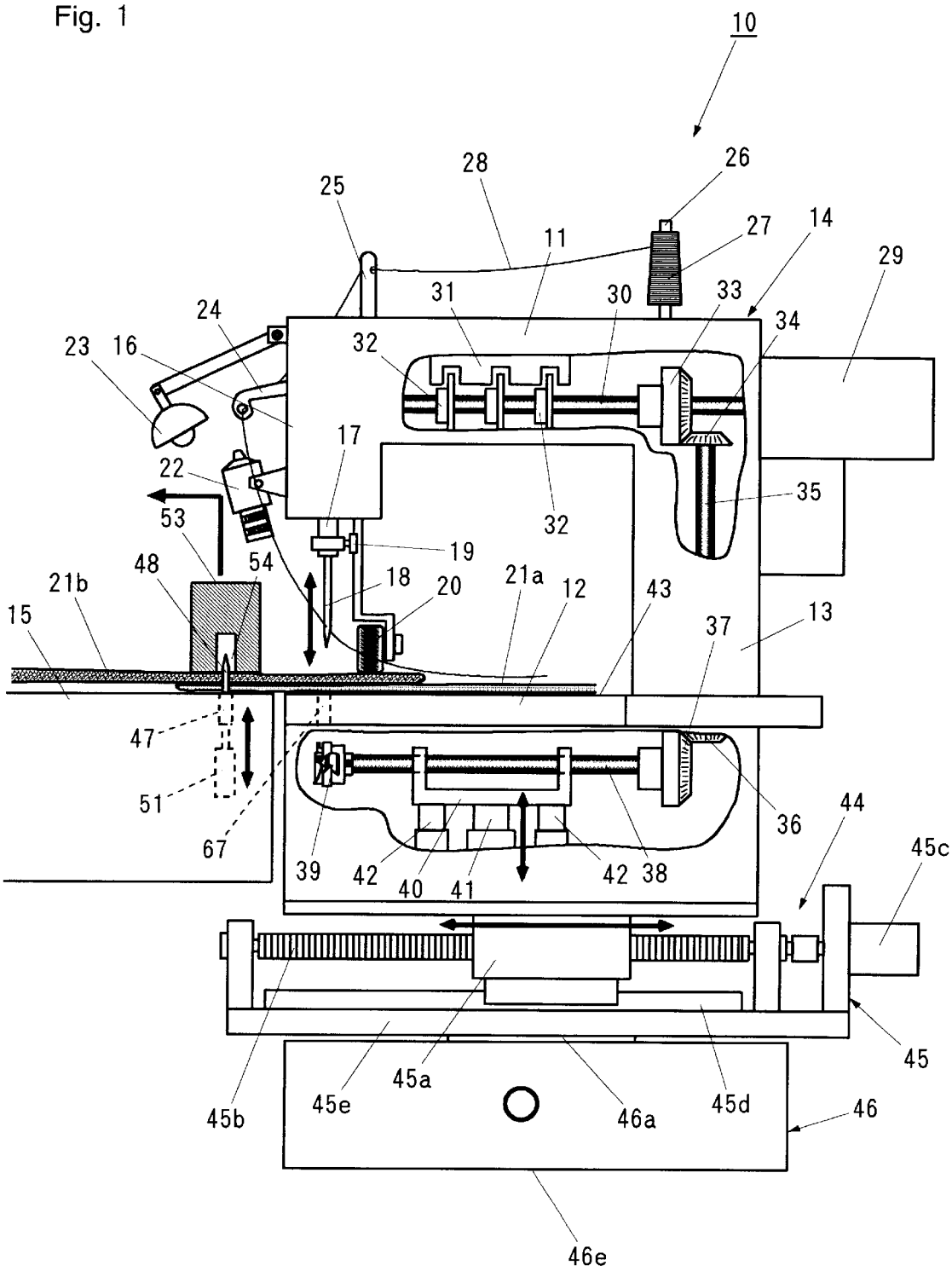
FIG. 1 is a side view of a first sewing system according to the present invention.
Figure 2:
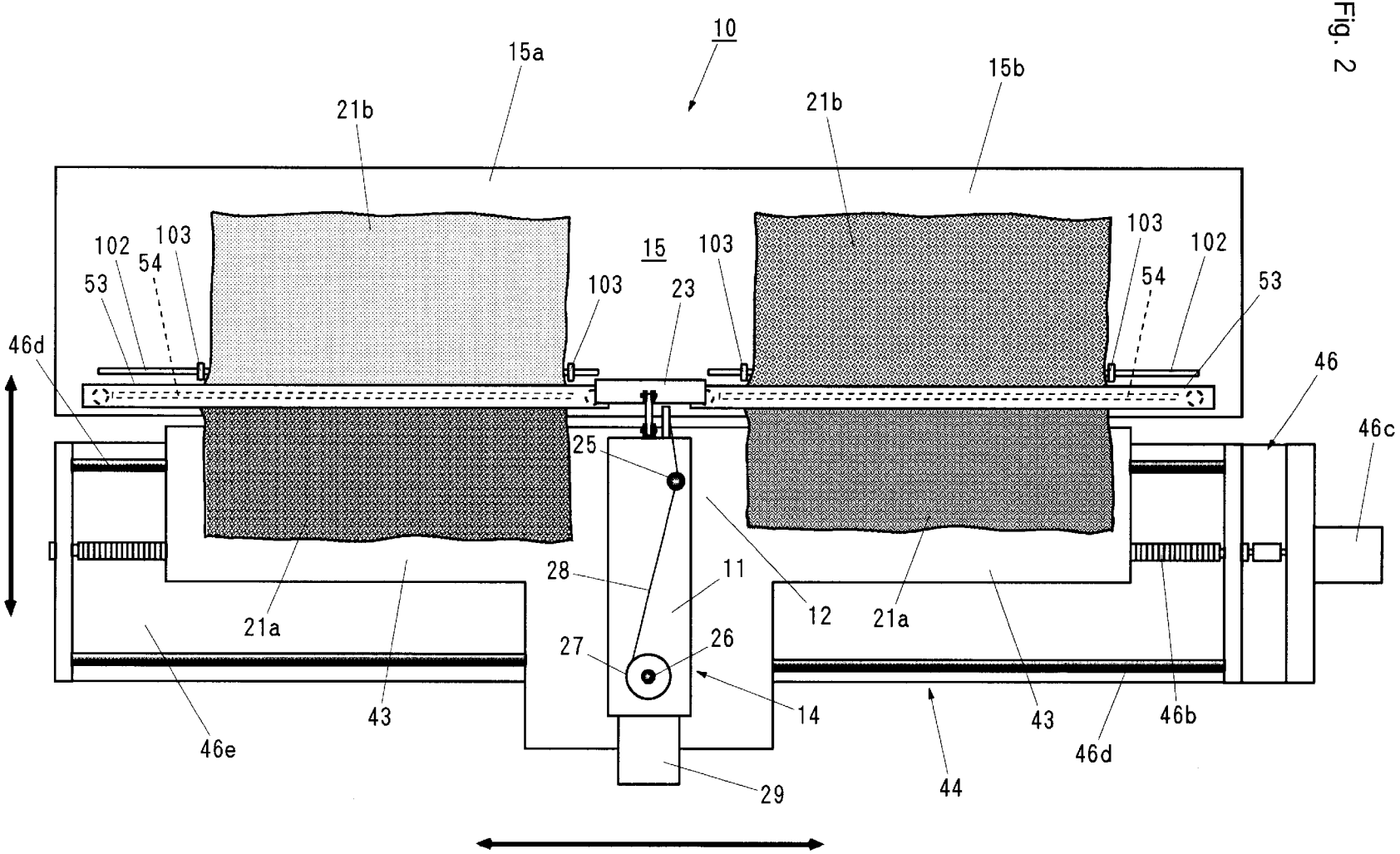
FIG. 2 is a plan view showing this sewing system.

FIG. 1 is a side view showing the construction of a first sewing system 10 as a whole, and FIG. 2 is a plan view of the same sewing system.

This first sewing system 10 is provided with a sewing machine body 14 comprising an arm 11 extending substantially horizontally, a sewing machine bed 12 extending in parallel with the arm 11, and a post 13 connecting the arm 11 and bed 12 together; and a setting table 15 disposed so as to be opposed to the bed 12 with a predetermined clearance left between the table and an opposed end of the bed 12.

As shown in FIG. 2, the table 15 is divided into a first setting region 15*a,* and a second setting region 15*b.*

The arm 11 is provided at its free end portion with a head 16 extending downward a little toward the bed 12, and a needle bar 17 projects from a lower end of the head 16, a sewing needle 18 being fixed detachably to a free end of the needle bar 17 by a screw 19.

A cloth holding wheel 20 projects from the lower end of the head 16. The cloth holding wheel 20 is adapted to press objects to be sewn 21*a,* 21*b,* which are placed on the bed 12, from an upper side thereof by an action of a coiled spring etc. (not shown), and thereby play a part in the prevention of disarrangement of the objects to be sewn 21*a,* 21*b,* during the sewing thereof, but it can be omitted.

A CCD camera 22 as an image sensor is fixed to a front side of the head 16. The CCD 22 camera is focused on a point at which the sewing needle 18 contacts the object to be sewn 21*b,* when the sewing needle 18 is lowered. The portion of the head to which the CCD camera is fixed is not specially limited, and it may be fixed to a rear side of the head 16.

A predetermined lamp 23 is fixed to the front side of the head 16. The range of illumination of this lamp 23 can be regulated by varying an angle of its joint portion. Instead of using such a lamp 23, a ring light may be provided around the CCD camera 22.

A balance 24 projects from an outer surface of the head 16.

A thread support bar 25 and a bobbin holder 26 are erected on an upper surface of the head 16, and a bobbin 27 is fitted around the bobbin holder 26. A sewing needle thread 28 sent out from the bobbin 27 is passed through a hole of the sewing needle 18 via through holes of the thread support bar 25 and balance 24.

A first servomotor 29 is fixed to a rear end of the arm 11. A driving shaft of the first servomotor 29 is joined to an upper shaft 30 provided so as to extend laterally in the interior of the arm 11.

An arm 11 is provided in the interior thereof with a rotation sensor 31 for detecting a rotational speed and a rotational frequency of the upper shaft 30. The rotation sensor 31 is provided with a light-emitting element and a light receiving element, and adapted to detect the condition of the upper shaft 30 by having the light receiving element catch the light emitted by the light-emitting element passed through slits of discs 32 mounted on an intermediate portion of the upper shaft 30.

The upper shaft 30 contains a crank mechanism (not shown) in a front end portion thereof, and a rotational movement of the upper shaft 30 is changed into a vertical movement of the needle bar 17 via the crank mechanism.

The upper shaft 30 is mounted at its rear end portion with a first bevel gear 33, which is meshed with a second bevel gear 34. The second bevel gear 34 is mounted on an upper end portion of a transmission shaft 35 provided vertically in the post 13. The transmission shaft 35 is mounted at its lower end portion with a third bevel gear 36, which is meshed with a fourth bevel gear 37.

The fourth bevel gear 37 is joined to a rear end of a lower shaft 38 provided laterally in the bed 12. The lower shaft 38 is mounted at its front end portion with a fully rotatable type shuttle 39. The shuttle 39 and a shuttle used in a so-called lock stitch sewing machine have construction substantially in common, and comprise a tip-carrying shuttle race body, and a shuttle hook (a shuttle body) storing therein detachably a bobbin around which a bobbin thread is wound. Since the construction of the shuttle is known, a detailed description thereof is omitted.

A driving shaft of an air cylinder 41 is joined to a lower surface of a bearing member 40 supporting the lower shaft 38. The lower shaft 38 can be moved together with the shuttle 39 vertically along guide members 42, 42 when the driving shaft of the air cylinder 41 is moved vertically. When the lower shaft 38 is moved to the uppermost position, the fourth bevel gear 37 is meshed with the third bevel gear 36, and, when the lower shaft 38 is moved to the lowermost position, these bevel gears leave each other.

Owing to this construction, when the upper shaft 30 is rotated by driving the first servomotor 29, the needle bar 17 and sewing needle 18 start being moved up and down, and simultaneously the rotation of the upper shaft 30 is transmitted to the lower shaft 38 via the transmission shaft 35 to cause the lower shaft 38 and shuttle 39 to be rotated as well. Namely, a rotational movement of the shuttle 39 is made in practice synchronously with the vertical movement of the sewing needle 18.

This sewing system described above is formed so that the lower shaft 38 as a whole is moved vertically in accordance with the vertical movements of the air cylinder 41 to cause each time the fourth and third bevel gears 37, 36 to be engaged with and disengaged from each other repeatedly. It may also be formed so that the shuttle 39 alone is moved up and down with the fourth and third bevel gears 37, 36 kept engaged, by contriving the construction of the lower shaft 38.

Figure 3:
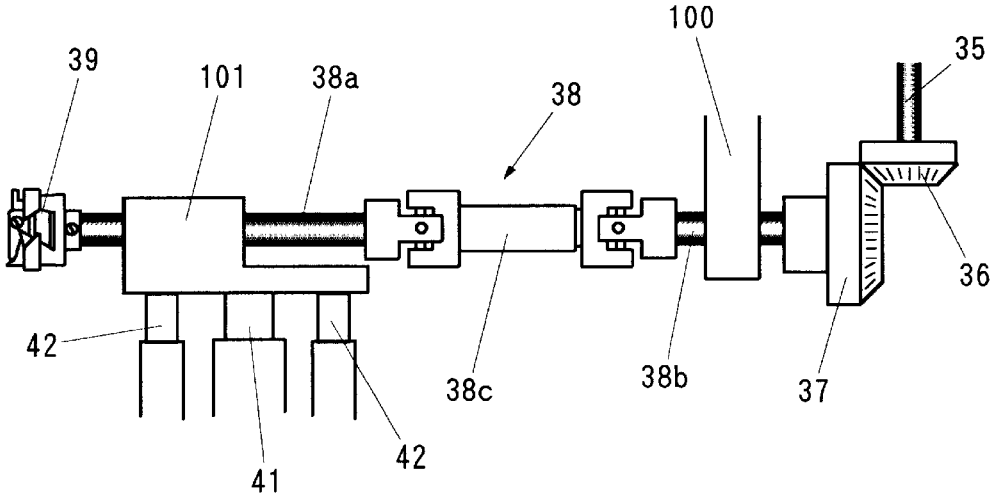
FIG. 3 is a partial sectional view showing a modified example of a lower shaft structure of a sewing machine body.

For example, the lower shaft 38 may be formed as shown in FIG. 3, of a front end side lower shaft 38*a* joined to a shuttle 39, a rear end side lower shaft 38*b* joined to a fourth bevel gear 37, and a universal joint 38*c* connecting the front end side lower shaft 38*a* and rear end side lower shaft 38*b* together.

The rear end side lower shaft 38*b* is rotatably supported on a fixed bearing member 100.

The front end side lower shaft 38*a* is rotatably supported on a movable bearing member 101.

A driving shaft of an air cylinder 41 is joined to a lower surface of the movable bearing member 101. When the driving shaft of the air cylinder 41 is moved up and down, the front end side lower shaft 38*a* together with the shuttle 39 are moved up and down along guide members 42, 42 but the rear end side lower shaft 38*b* is not. Accordingly, the meshed condition of the fourth and third bevel gears 37, 36 is maintained.

The rotational movements of the third and fourth bevel gears 36, 37 are, of course, transmitted to the front end side lower shaft 38*a* via the universal joint 38*c,* so that the shuttle 39 can be rotated synchronously with the rotation of the upper shaft 30.

As shown in FIG. 2, the surface of the bed 12 projects to left and right to form tables 43 on the side of a sewing machine body 14.

The sewing machine body 14 is placed and fixed on an X–Y table 44. This X–Y table 44 is provided with an X-axis feed mechanism 45 adapted to move the sewing machine body 14 in the direction perpendicular to the axis of the table 15, and a Y-axis feed mechanism 46 adapted to move the sewing machine body 14 in the lateral direction along the table 15.

The X-axis feed mechanism 45 is provided with a first movable member 45*a* joined to a bottom surface of the bed 12, a ball screw 45*b* engaged with the first movable member 45*a,* a second servomotor 45*c* for rotating the ball screw 45*b,* and a direct-acting bearing 45*d,* etc.

The Y-axis feed mechanism 46 is provided with a second movable member 46*a* joined to a bottom surface of a base member 45*e* of the X-axis feed mechanism 45, a ball screw 46*b* engaged with the second movable member 46*a,* a third servomotor 46*c* for rotating the ball screw 46*b,* a direct-acting bearing 46*d,* and a base member 46*e,* etc.

Figure 4:
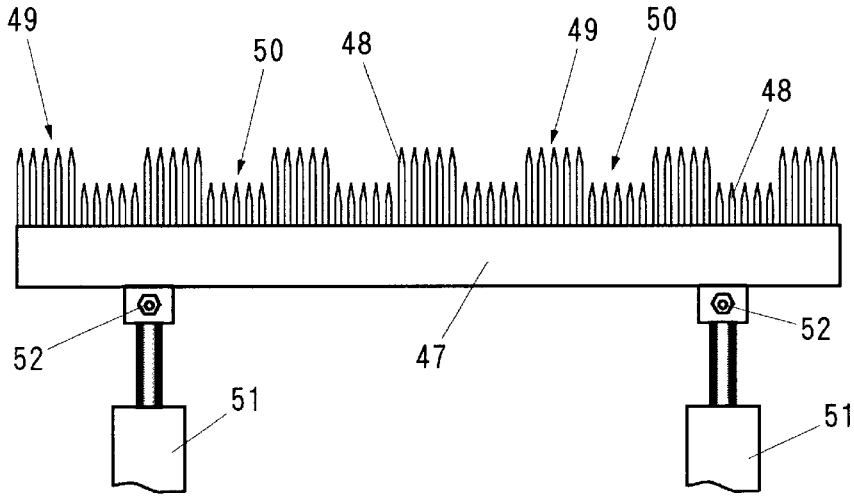
FIG. 4 is a front view showing an example of a fixing throat plate.

The table 15 is provided therein with a fixing needle throat plate 47 as shown in FIG. 1, and the fixing needle throat plate 47 has a plurality of fixing needles 48 erected on one straight line at small intervals as shown FIG. 4. The fixing needles 48 do not have the same size but they comprise alternately arranged groups 49 of a plurality of longer needles and groups 50 of a plurality of shorter needles. The size of the longer needles is set to, for example, 2 cm, and that of the shorter needles, for example, 1 cm.

The fixing needle throat plate 47 is provided so that it can be moved up and down by an operation of an air cylinder 51 or a solenoid, etc., and it is set so that, when the fixing needle throat plate 47 has reached the highest position, both the longer and shorter fixing needles 48 project from the surface of the table 15, and so that, when the fixing needle throat plate 47 has reached the lowest position, the fixing needles 48 completely sink in the interior of the table 15.

The fixing needle throat plate 47 can be replaced by removing set screws 52 by other fixing throat plate having fixing needles 48 of different heights, thicknesses and intervals, etc. The fixing needle throat plate may, of course, be replaced by another provided with a plurality of fixing needles 48 of the same size.

The fixing needle throat plates 47 are provided in the first setting region 15*a,* and second setting region 15*b* respectively.

A pressure member 53 is provided on the surface of the table 15. This pressure member 53 comprises a comparatively long angular metal material, etc., and is arranged in the first setting region 15*a* and second setting region 15*b* respectively as shown in FIG. 2.

The pressure members 53 are provided in their lower surfaces with longitudinally extending grooves 54, which have such a depth that permits the fixing needles 48 fully projecting from the surface of the table 15 to be completely housed therein.

The pressure members 53 are arranged so that they can be moved vertically and longitudinally by suitable driving units (not shown), such as air cylinders or solenoids.

A woven fabric 21*a* and a knitted fabric 21*b* as objects to be sewn are arranged and fixed on the table 15 in the following procedure.

First, the pressure members 53 are lifted to a sufficient height by operating a switch (not shown), and moved back to positions in which a fabric setting operation is not obstructed.

The fixing needle throat plates 47 are then lifted to the highest positions by operating a switch (not shown). As a result, the fixing needles 48 project from the surface of the table 15 and thrust, up to their root portions, the overlapping portions of the knitted fabric 21*b* and woven fabric 21*a* along one straight line.

Each fixing needle throat plate 47 has two types of fixing needles 48, i.e. higher and lower needles arranged alternately in groups 49, 50 as mentioned above. Therefore, the longer needles alone are thrust for the time being into the objects to be sewn 21*a,* 21*b,* in such a manner that these needles stand on one straight line, and the objects to be sewn 21*a,* 21*b* are then pressed down at a stroke, whereby the objects to be sewn 21*a,* 21*b* can be thrust at once by the shorter needles as well which are positioned among the longer needles, in such a manner that the needles stand on substantially the same line.

These fixing needles 48 are provided only for setting the objects to be sewn 21*a,* 21*b,* in such a manner that the objects to be sewn do not move during a sewing process, and not for arranging stitching in order unlike conventional fixing needles. Therefore, it is not necessary that the fixing needles 48 thrust the stitches of the knitted fabric 21*b* one by one accurately. It is also unnecessary that the thickness of the fixing needles 48 and the diameter of the stitches completely correspond to each other.

During this time, parts (portions to be sewn) of overlapping portions of the objects to be sewn 21*a,* 21*b* are placed on the section as well of the bed 12 which is on the side of the sewing machine body 14.

Each pressure member 53 is then moved forward by operating a switch (not shown), to a position above the fixing needles 48 and thereafter to the lowest position to press the surfaces of the objects to be sewn 21*a,* 21*b* at a predetermined level of pressure. Consequently, the fixing needles 48 as a whole are housed in the groove 54 of the pressure member 53, so that the objects to be sewn 21*a,* 21*b* are firmly fixed by the pressure member 53 and fixing needles 48.

The cloth holding wheel 20 is brought into contact with the surface of the overlapping portions of the sections of the objects to be sewn 21*a,* 21*b* which are placed on the side of the sewing machine body 14.

The arranging and fixing of the objects to be sewn 21*a,* 21*b* are done on the first setting region 15*a* and second setting region 15*b* respectively of the table 15.

The sewing machine body 14 is driven with the other parts in the above-mentioned condition by a method which will be described in detail later, to complete the sewing operation on the first setting region 15*a.* The pressure member 53 on the side of the first setting region 15*a* is then moved to a position in which it does not obstruct the replacement of the objects to be sewn 21*a,* 21*b,* and the fixing needles 48 are housed in the table 15, the sewn objects being then removed. While the sewing machine body 14 carries out the sewing operation on the second setting region 15*b,* unsewn objects 21*a,* 21*b* are fixed on the first setting region 15*a* by the same procedure as mentioned above.

Figure 5:
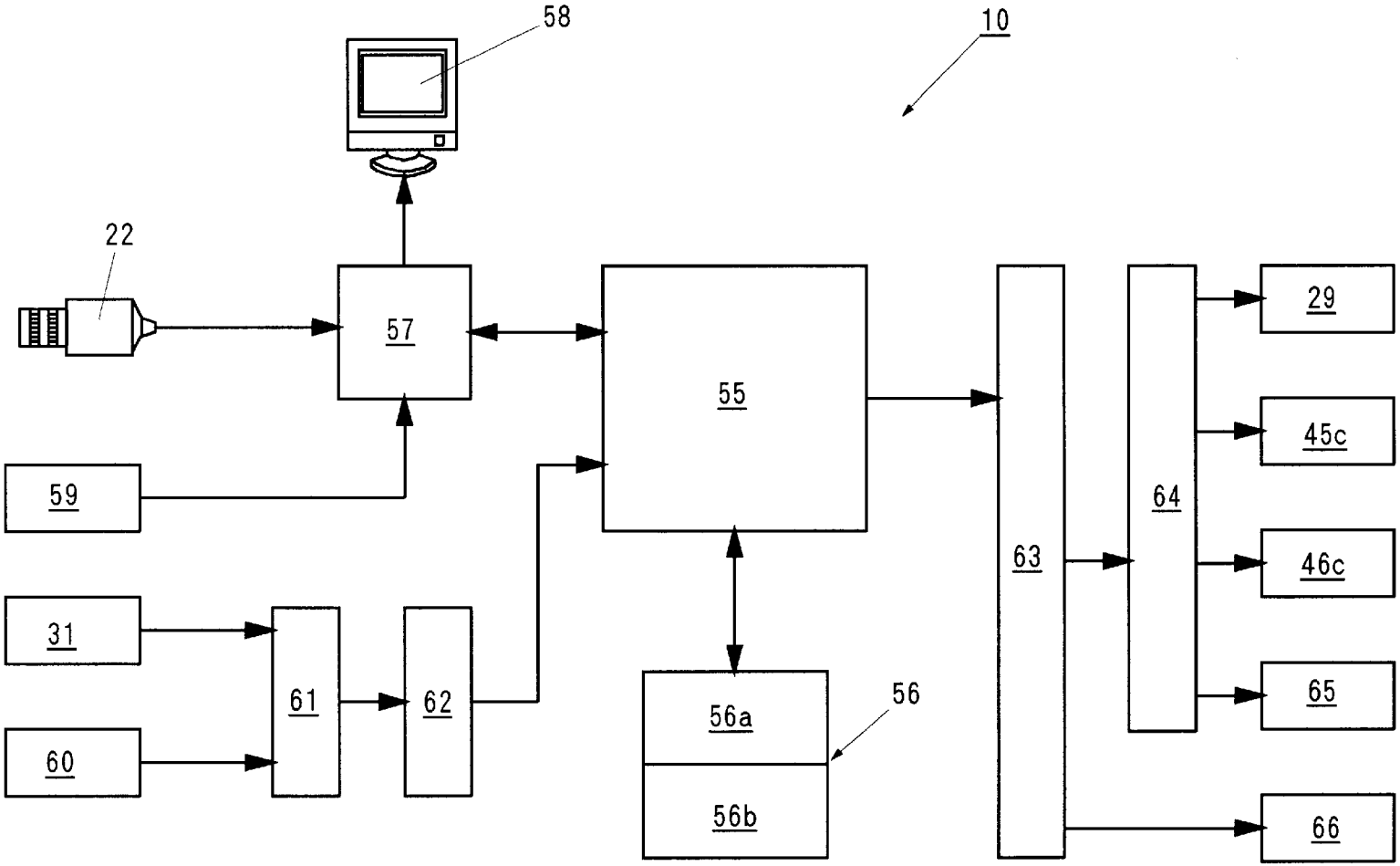
FIG. 5 is a block diagram showing a control system for the sewing system.

FIG. 5 is a block diagram showing a principal portion of a control mechanism for the first sewing system 10, which is provided with a control unit 55 and a storage 56.

The control unit 55 comprises a CPU, for example, a programmable controller, a microcomputer, a personal computer, or an engineering work station.

The storage 56 comprises a ROM 56*a* in which a control program for the first sewing system 10 is stored, and a RAM 56*b* in which data on various setting conditions etc. are temporarily stored.

A controller 57 for the CCD camera 22 is connected to an input side of the control unit 55, and, besides the CCD camera 22, a monitor 58 and a console 59 as an input unit or a keyboard (not shown) and ten keys (not shown) etc. to the image controller 57. The rotation sensor 31 provided in the sewing machine body 14 and other various kinds of sensors 60 are connected to the control unit 55 through a signal processing circuit 61 and an input interface 62.

A first servomotor 29, a second servomotor 45*c*, a third servomotor 46*c* and a driving system 65 for the air cylinder 41 are connected to an output side of the control unit 55 through an output interface 63 and a driving circuit 64. Various output units 66, such as a display lamp and an alarm buzzer are also connected to the control unit 55 through the output interface 63.

The basic operation of the first sewing system 10 will be described with reference to the flow chart of FIG. 6. The description will be given on the assumption that the knitted fabric 21*b* and woven fabric 21*a* as objects to be sewn have already been arranged and fixed on the first setting region 15*a* and second setting region 15*b* of the table 15.

First, the X–Y table 44 is driven by turning on the switch (not shown), to move the sewing machine body 14 to a position in which the CCD camera 22 can image the portion to be sewn of the knitted fabric 21*b*.

An image of the portion to be sewn is fetched via the CCD camera 22. The shape of the guide patterns indicative of the stitches to be thrust by the sewing needle 18 are set on the basis of the fetched image, and the position of the stitches to be sewn, on the basis of the guide patterns, these set results being stored in the storage 56 (S1).

Concretely speaking, predetermined guide patterns are provided in advance on the portion of the surface of the knitted fabric 21*b* which is in the vicinity of the stitches to be sewn, and the console 59 is operated as an enlarged image taken by the CCD camera 22 and projected on the monitor 58 is observed, to designate the stitches by enclosing figures of the guide patterns with a search window, and specify a target portion of the fabric in the search window by enclosing it with a pattern window, whereby the stitches to be sewn are set. The method of setting the stitches constituting a target will be described later.

A start switch (not shown) is then turned on to move the sewing machine body 14 laterally, and have the control unit 55 make a search for patterns similar to the stored target patterns out of the image data inputted from the CCD camera 22 and image processed by the image controller 57, and read the pitch of (distance between) the patterns. The pitch information thus read is stored (S2) as a reference pitch in the storage 56. Instead of reading the reference pitch in this manner by using the CCD camera 22, a numerical value thereof can be inputted directly by using an input means, such as a keyboard or ten keys.

When this reference pitch reading operation has been completed, it is known to the outside by turning on a display lamp or displaying a concrete pitch value on the monitor 58 with the sewing machine body 14 automatically moved to its original position (a position halfway between the first setting region 15*a* and second setting region 15*b* of the table 15).

The description ended with the last paragraph is of a preparation stage, and a real sewing stage is started by turning on an automatic operating switch (not shown). First, the sewing machine body 14 is automatically moved (S3) to a sewing starting position in the first setting region 15*a* on the basis of an instruction from the control unit 55, and temporarily stopped with the air cylinder 41 operated to cause the lower shaft 38 of the sewing machine body 14 and shuttle 39 to be lifted to a sewing executable position.

The image data fetched from the CCD camera 22 and subjected to image processing, such as digitalization and thinning in the image controller 57 are analyzed in the control unit 55, and a search for a pattern agreeing with already-stored guide pattern data is made (S4) to detect (S5) coordinates on which a first stitch to be sewn is positioned, with the second servomotor 45*c* and third servomotor 46*c* driven to move (S6) the sewing machine body 14 in the XY directions so that it reaches a position in which the sewing needle 18 can thrust through the same stitch.

The first servomotor 29 is then driven on the basis of an instruction from the control unit 55, whereby the sewing needle 18 with the needle thread 28 passed through the hole thereof starts lowering. This sewing needle 18 passes through the first stitch of the knitted fabric 21*b* and carries the needle thread 28 to a position in the vicinity of the shuttle 39 via a bore 67 formed through the bed 12, and then turns into an upward movement.

The shuttle 39 which has already started its rotational movement synchronously with the movement of the sewing needle 18 captures at its tip the needle thread 28 during an upward movement of the sewing needle 18, sends out the bobbin thread (not shown), which is stored in the interior thereof, in the midst of the rotation thereof, and intertwines the bobbin thread with the loops of the needle thread 28 to form a seam of so-called lock stitches.

While the sewing needle 18 thus makes one cycle of downward and upward movements, the shuttle 39 makes two full turns, whereby the sewing of the first stitch of the knitted fabric 21*b* and the woven fabric 21*a* together is completed (S7) by a distance corresponding to that between two adjacent stitches.

Even while a lock stitch sewing operation is carried out by the sewing needle 18, the control unit 55 makes an analysis of the image data sent from the CCD camera 22, and carries out a search (S8) for a subsequent guide pattern and the detection (S9) of the coordinates on which a subsequent stitch to be sewn is positioned. A difference between the reference pitch stored in advance and the actually detected coordinates is computed, and corrections are made (S10) on the reference pitch on the basis of the computation results, the sewing machine body 14 being moved (S11) to a position in which a second stitch can be sewn. The sewing needle 18 is moved down and up to effect (S12) the sewing of the same stitch.

The same steps are thereafter carried out repeatedly to sew up the stitches sequentially.

At an instant (13) at which a preset sewing finishing position has been detected, the control unit 55 interrupts its operation for detecting a subsequent guide pattern, and stops (S14) the sewing operation. The air cylinder 41 is driven to lower the shuttle 39 to the original position, and the sewing machine body 14 is returned (S15) to the original position after the thread has been cut off.

When the start switch is then pressed again, the sewing machine body 14 is moved to the second setting region 15*b* on the table 15, and the operation of the sewing machine body is shifted in the same manner as mentioned above to a lock stitch sewing step via a step of storing guide patterns indicative of stitches to be sewn and a step of reading a reference pitch.

Thus, while the sewing machine body 14 is engaged in the sewing operation for the second setting region 15*b*, the pressure member 53 is lifted with the fixing needle throat plate 47 lowered at the same time, and the sewn object is removed to set subsequent objects to be sewn 21*a,* 21*b* in the first setting region 15*a*.

When these operations are repeated, the sewing work can be carried out continuously and efficiently by one sewing machine body 14.

The above description is given on the assumption that different sets of objects to be sewn 21*a,* 21*b* are arranged and fixed on the first and second regions 15*a,* 15*b*. In order to sew a plurality of knitted fabrics 21*b* having stitches of completely the same pattern, the step of setting and storing stitches to be sewn and the step of reading a reference pitch are carried out only once each in an initial sewing operation, and the data on the first sewing operation is utilized thereafter, whereby more efficient sewing work can be effected.

In the above-described sewing work, the sewing machine body 14 is operated continuously without being stopped. The sewing work may be programmed so that the sewing machine body is shifted to a low-speed operation when the sewing needle 18 has entered into an ascending stroke, to secure a subsequent search for a guide pattern, and to a high-speed operation again when the guide pattern has been detected to cause the sewing needle 18 to enter into a descending stroke. To be exact, these operations are attained by the control unit 55 which reads the angle of rotation and rotational frequency of the upper shaft 30 on the basis of output data from the rotation sensor 31 which is monitoring the rotational condition of the upper shaft 30, and which regulates the rotational speed of the first servomotor 29 on the basis of the read data.

The sewing machine may also be programmed so that, for example, when the coordinates detected as coordinates on which a subsequent stitch to be sewn is positioned has a deviation of not lower than a predetermined numerical value from the coordinates computed on the basis of a reference pitch, a judgement that a skip error occurs is given to have the sewing needle return to the preceding portion to be sewn and have a search for a guide pattern made again.

The setting and detecting of the sewing starting and ending positions are done in practice, for example, in the following manner.

First, as shown in FIG. 2, projections 103 slidable in predetermined ranges along grooves 102 are provided in the first and second setting regions 15*a,* 15*b,* and sensors (not shown) capable of detecting the projections 103 on the sewing machine body 14.

After the objects to be sewn 21*a,* 21*b* have been arranged and fixed on these setting regions, the projections 103 are slid to positions in which the projections contact the sides of the objects to be sewn.

Consequently, each time the sensors on the sewing machine body 14 detect the projections 103 in accordance with the movement of the sewing machine body 14, the sewing starting and ending positions can be detected.

The sewing machine may also be so constructed that the sewing starting and ending positions are detected by identifying the shape, which has been stored in the storage 56 through the CCD camera 22, of the projections 103 instead of providing special sensors on the sewing machine body 14.

The first sewing system 10 according to the present invention chiefly aims at making corrections on the initially set reference pitch and correcting the course which the sewing machine body 14 is to follow and an amount of movement thereof when the machine body judges that its movement according to the mentioned reference pitch cannot attain the arrival of the sewing needle at the position of a subsequent stitch after carrying out as mentioned above the steps of detecting the part of image data obtained by the CCD camera 22 which agrees with image data on the guide patterns stored in advance, accurately specifying on the basis of the detected data the coordinates on which a stitch to be subsequently sewn exists, and computing a difference between these coordinates and those on which the sewing needle 18 is actually positioned.

Accordingly, an accurate obtainment of images of guide patterns by the CCD camera 22 constitutes the most important key to the achievement of the present invention.

The CCD camera 22 used in this sewing system is specially adapted to image a contour pattern of an object but it cannot always be said that a stitch of the knitted fabric 21*b* is provided with a clear contour pattern. The respective stitches of the knitted fabric rather have a vague and deformed shape.

Figure 7:
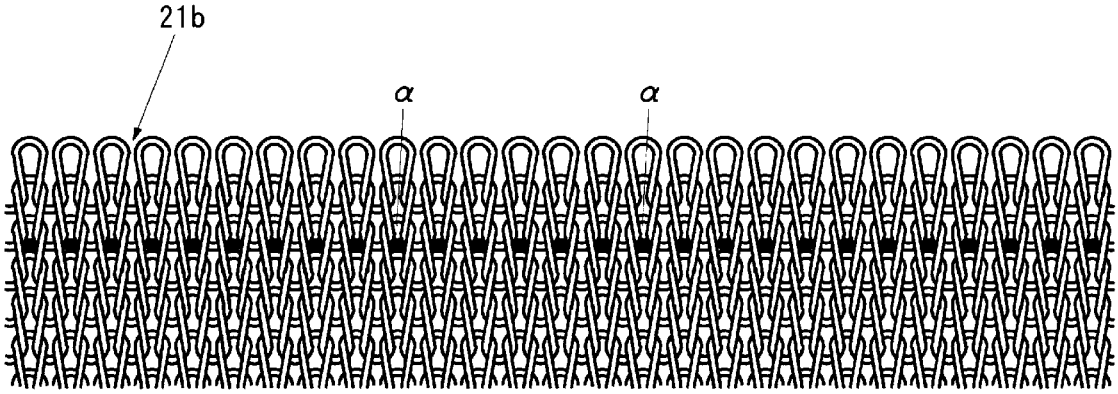
FIG. 7 is a plan view showing a knitted fabric as an object to be sewn.
Figure 8:
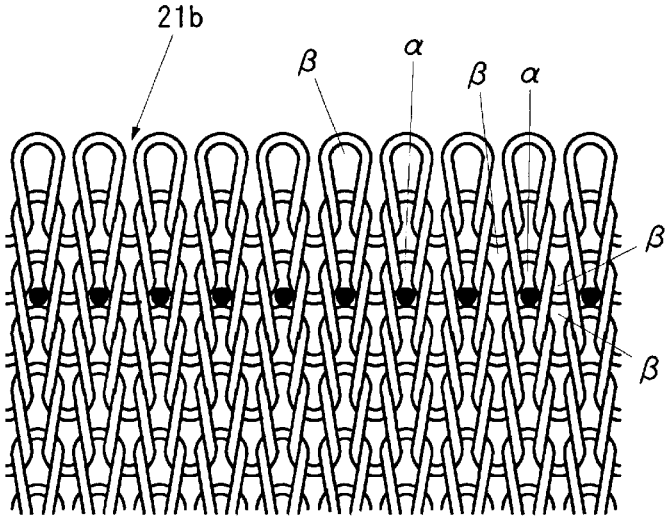
FIG. 8 is an enlarged view of the knitted fabric.

As shown in FIG. 7, in order to linearly sew a plurality of stitches α, which are shown by imaginary black dots, out of predetermined stitches provided on the knitted fabric 21*b,* it is difficult, due to a lot of similar stitches β existing on the upper and lower sides of the same stitches α as shown in FIG. 8, to accurately extract a subsequent stitch α to be sewn, during a movement of the sewing machine body 14 even when the pattern of a loop forming one stitch α has been stored, and, as a result, it becomes impossible to sew the stitches α linearly.

Figure 9:
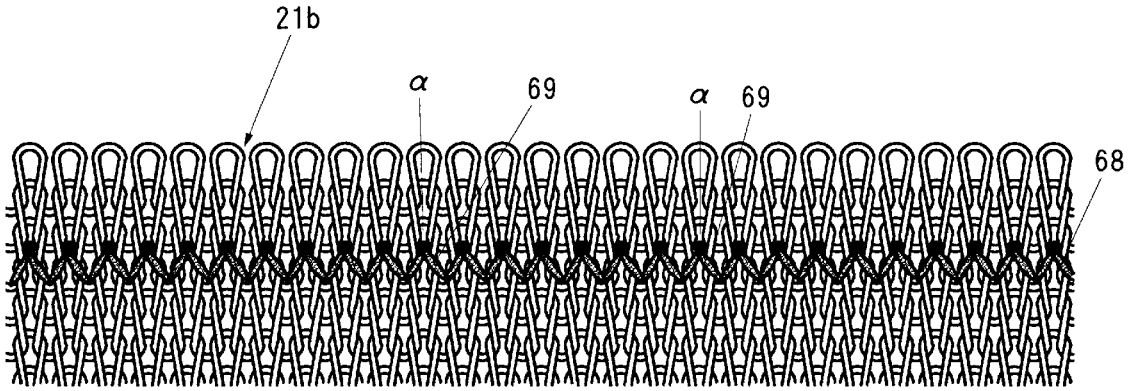
FIG. 9 is a plan view showing the condition in which guide patterns are formed by knitting a waste thread into the knitted fabric.
Figure 1:
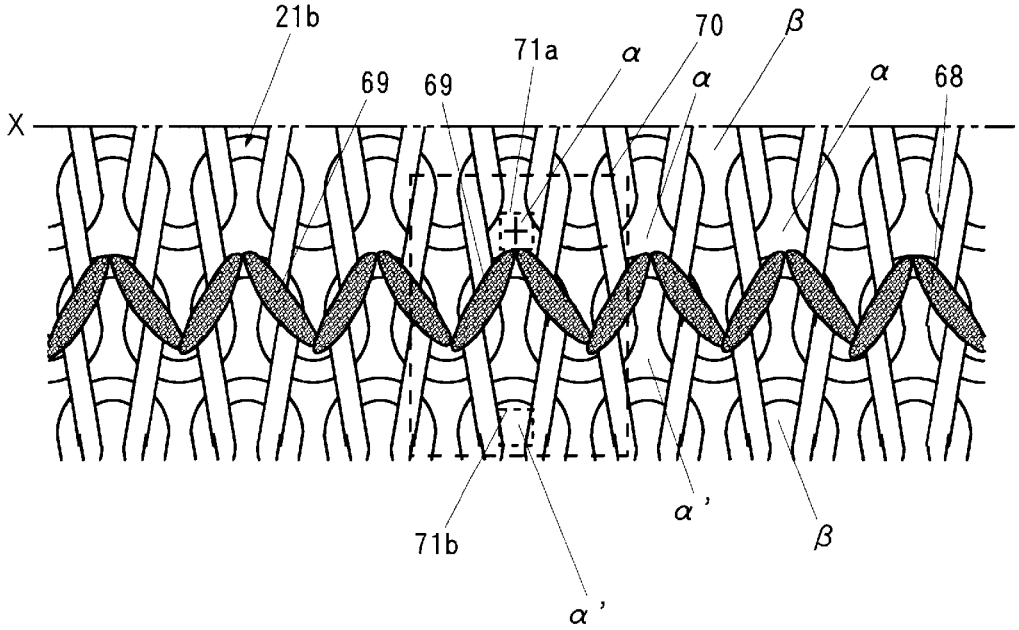
Figure 1:
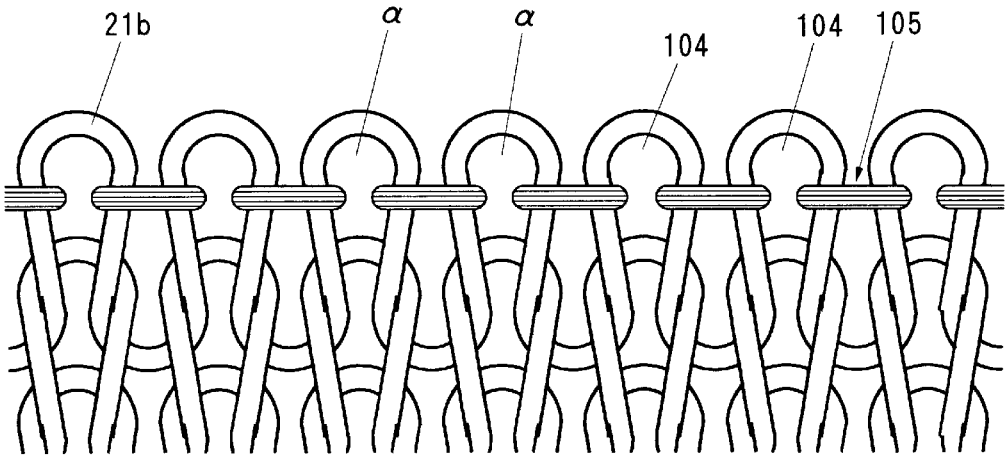
Figure 1:
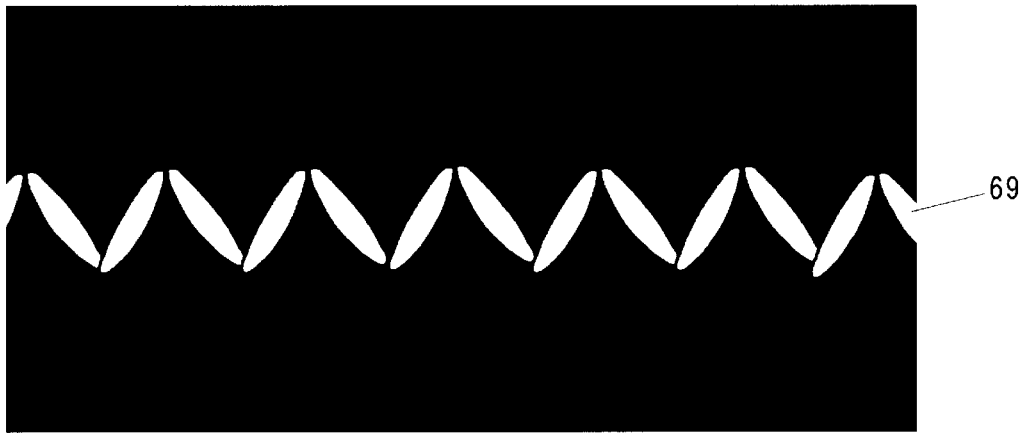
Figure 1:
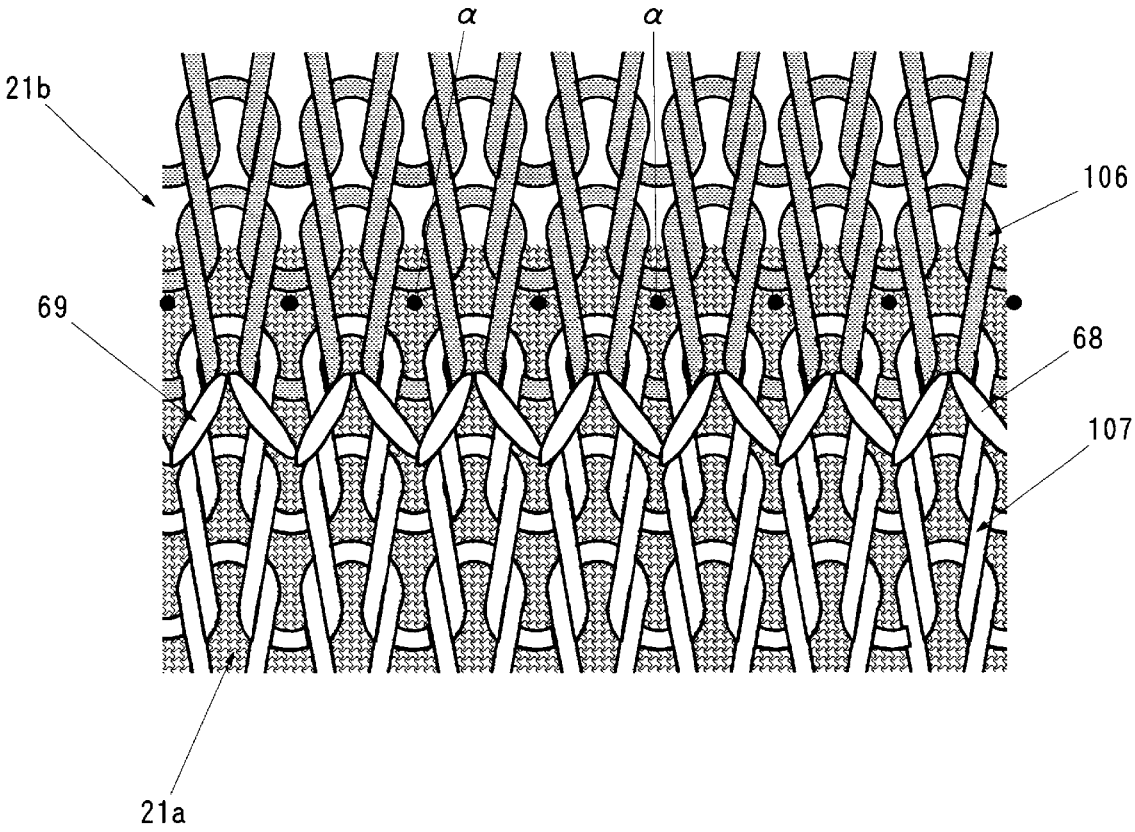
Figure 1:
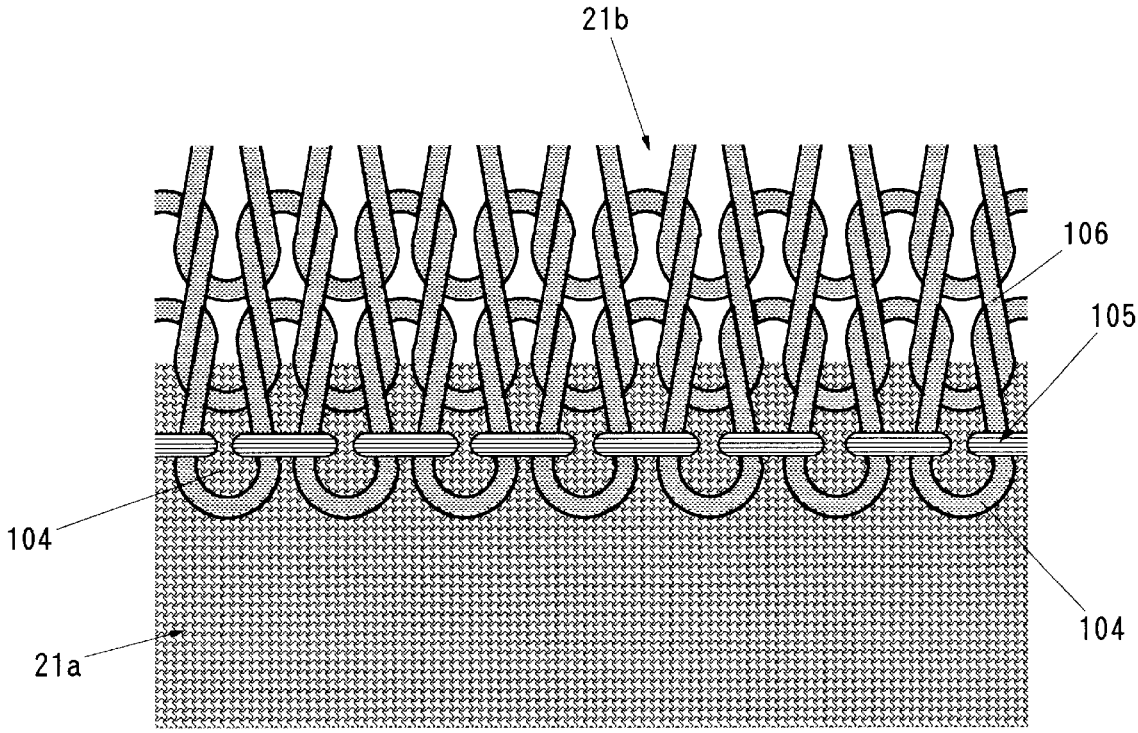
Figure 1:
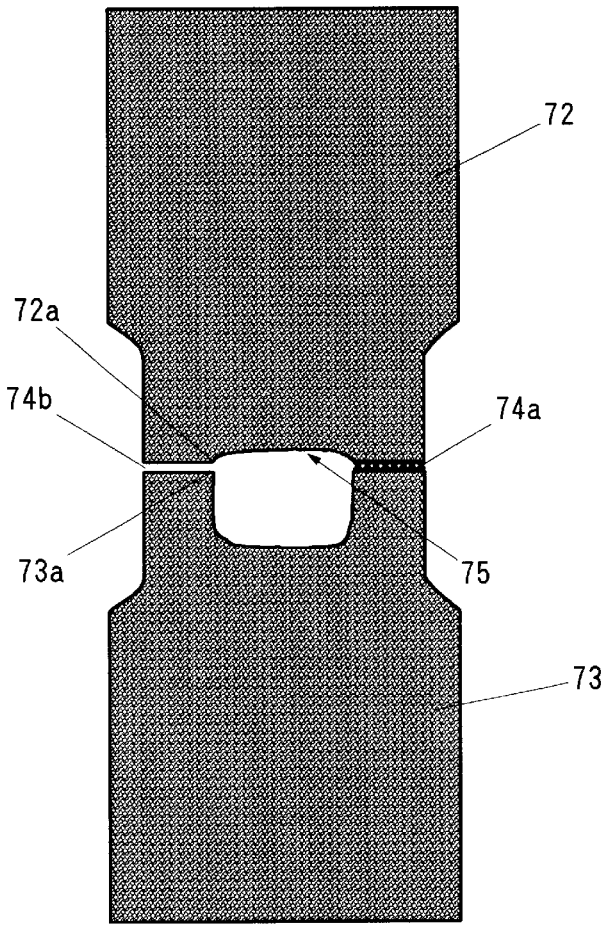
Figure 1:
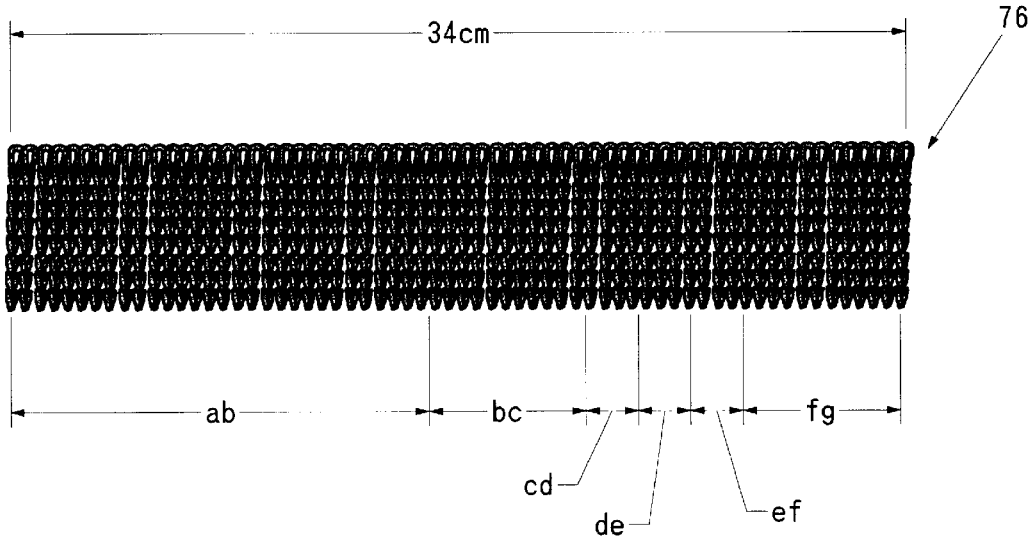
Figure 1:
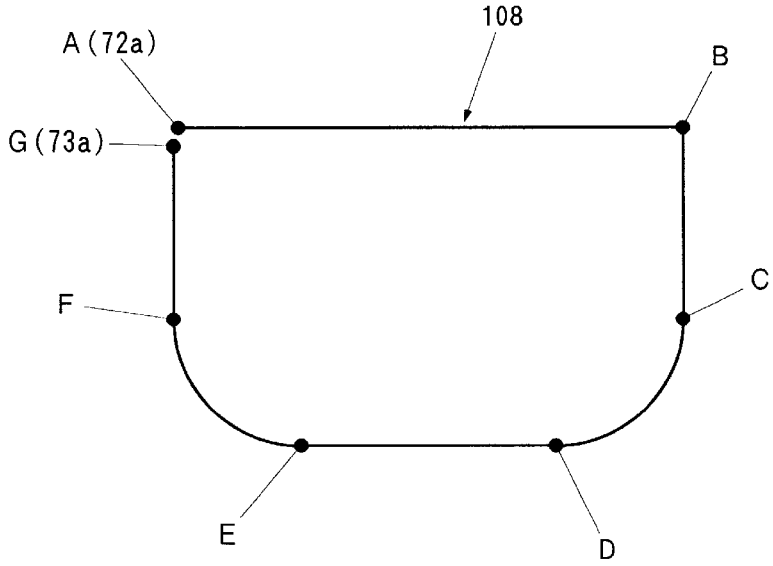
Figure 1:
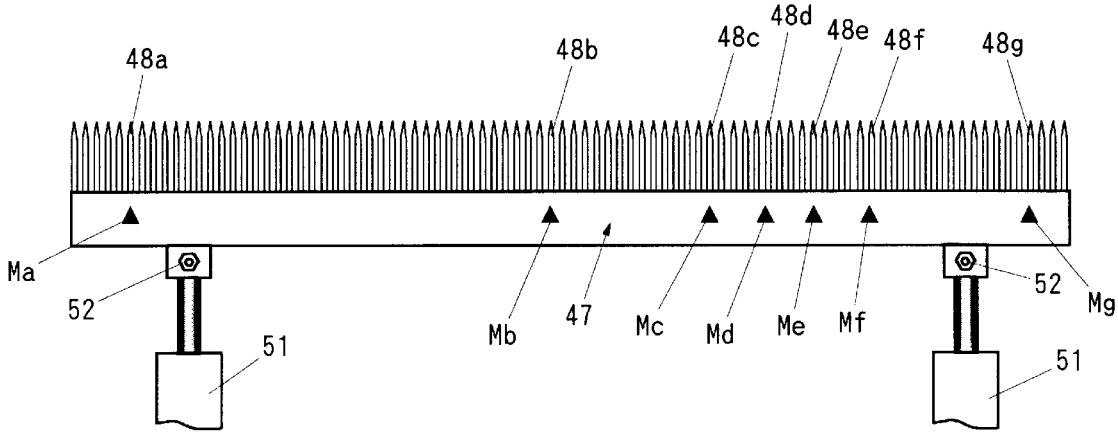
Figure 1:
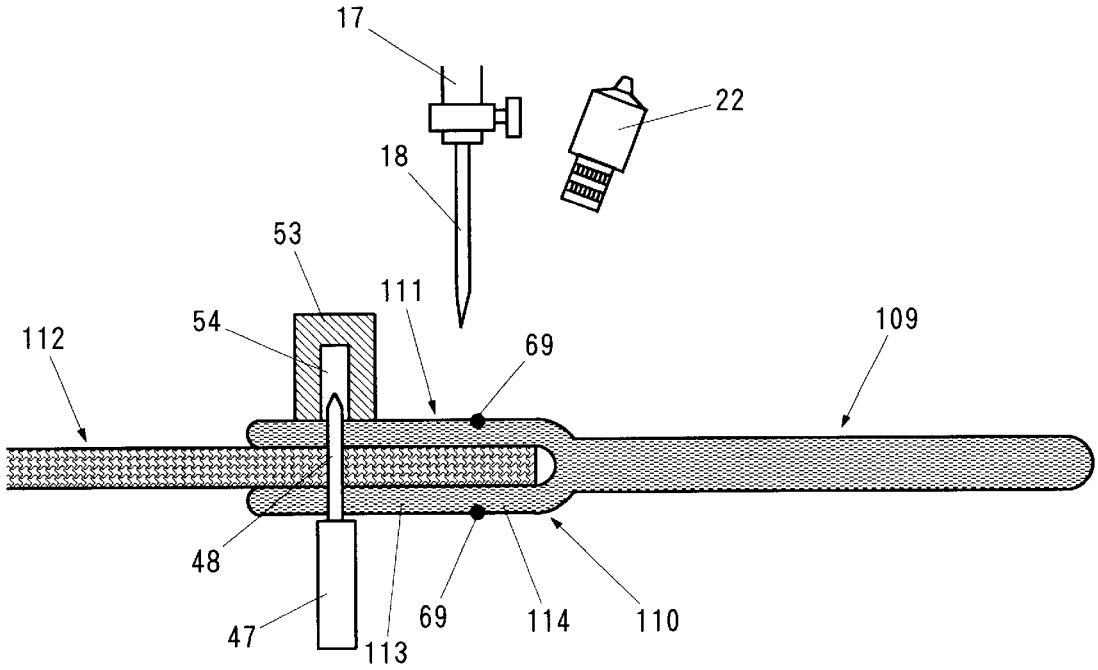
Figure 2:
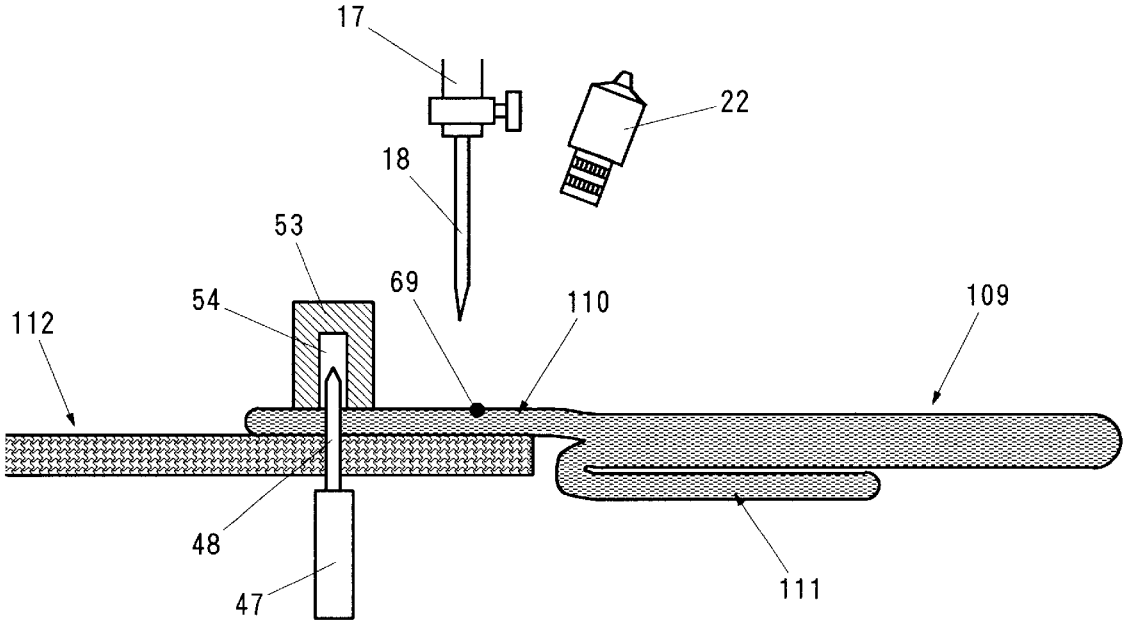
Figure 2:
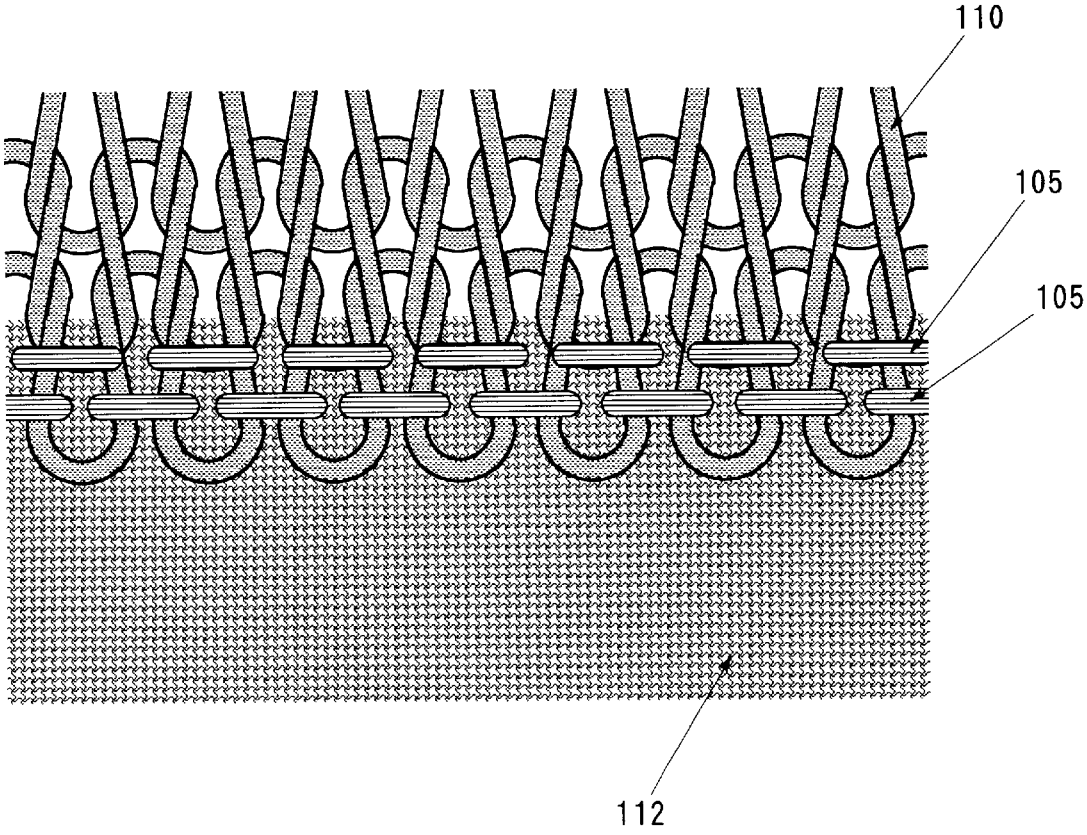
Figure 2:
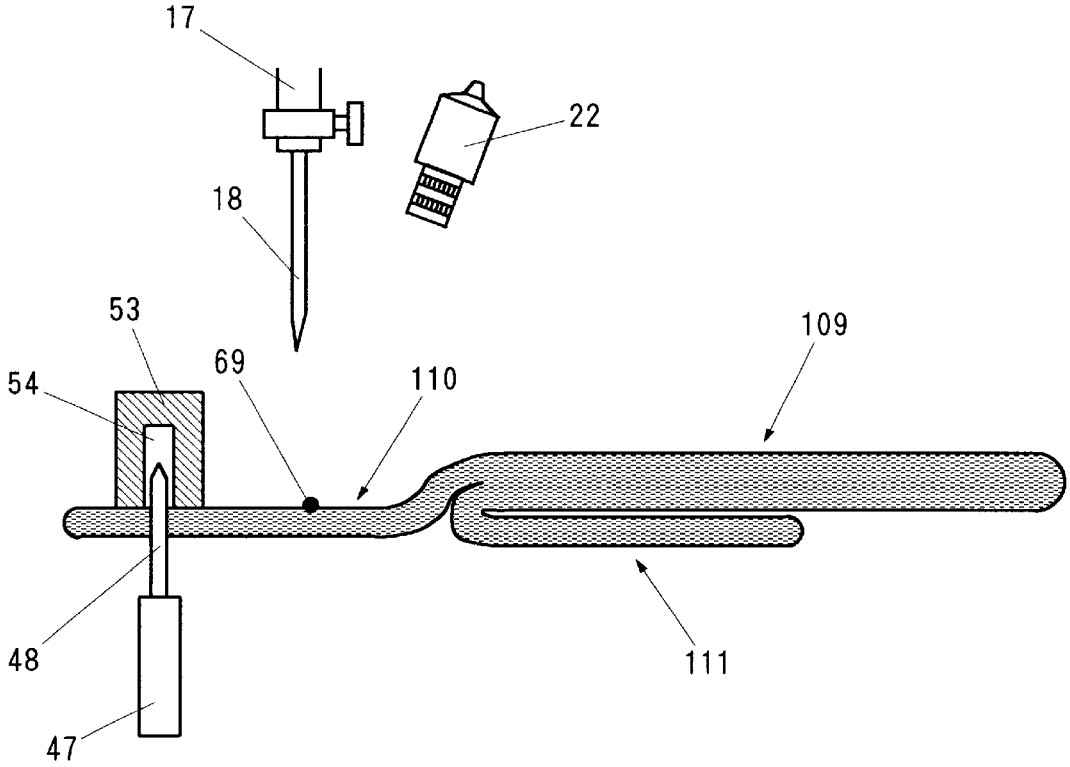
Figure 2:
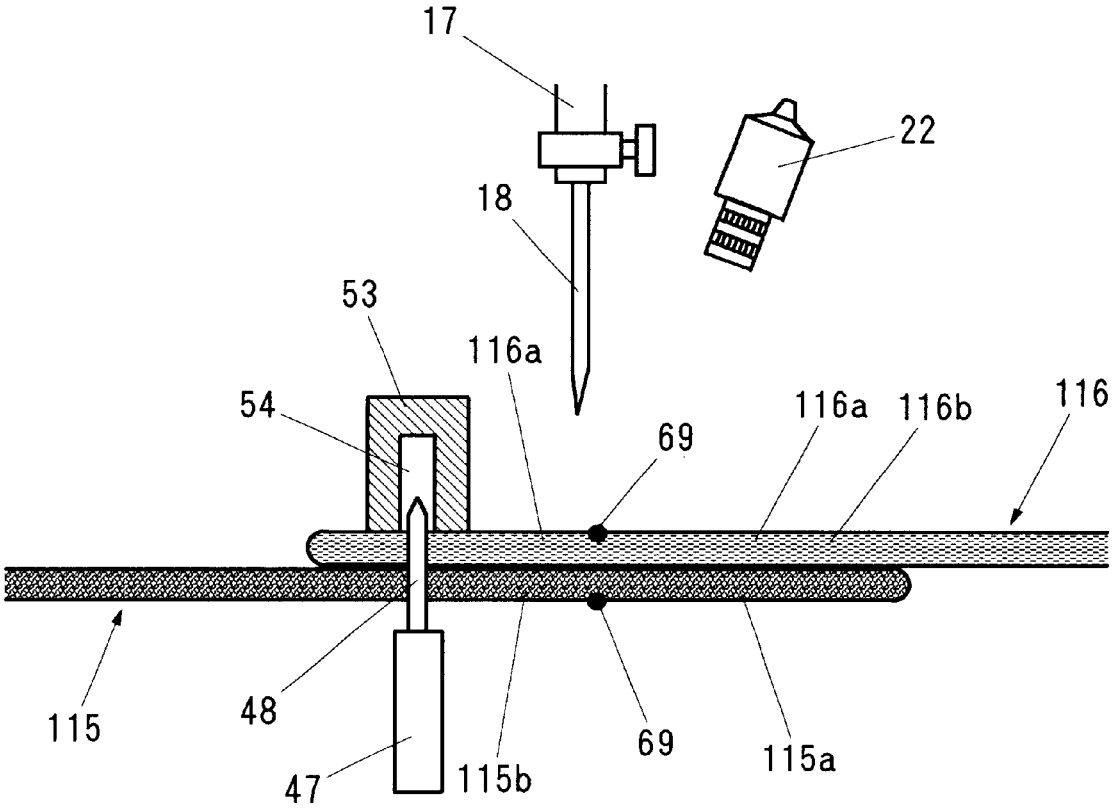
Figure 2:
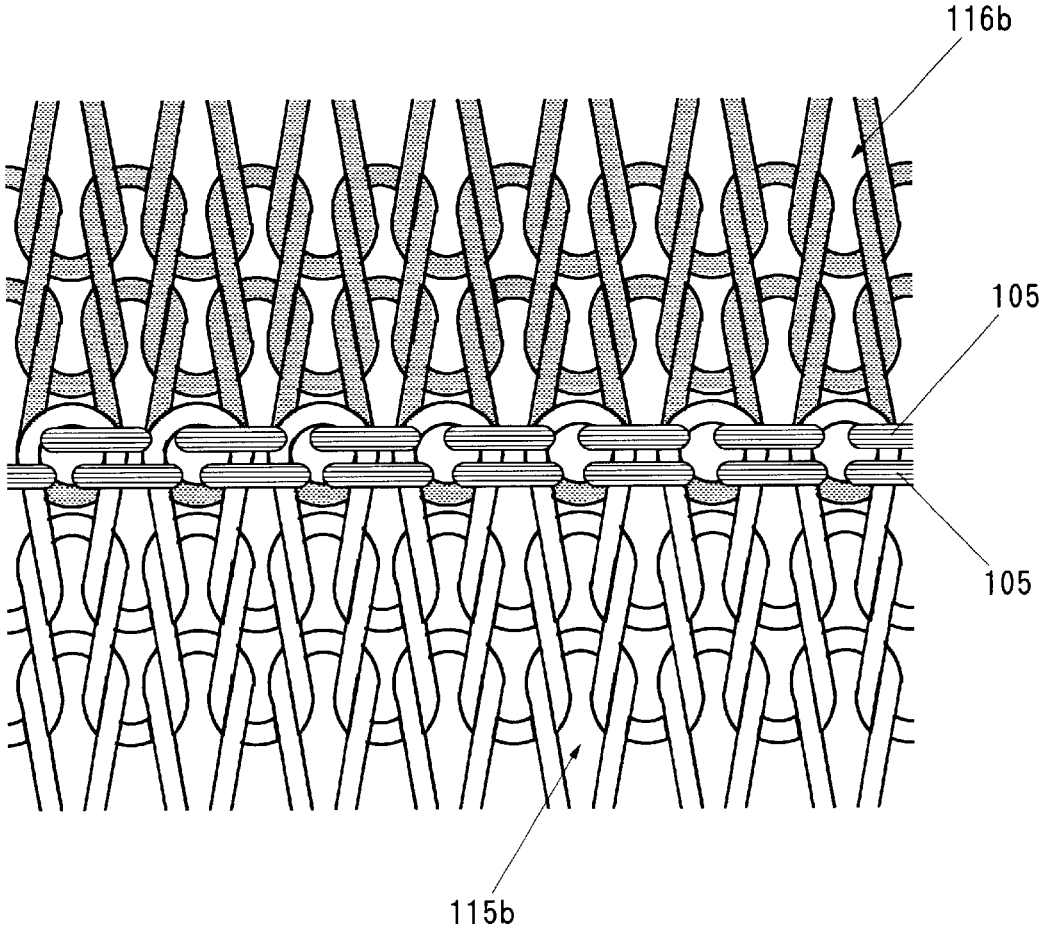
Figure 2:
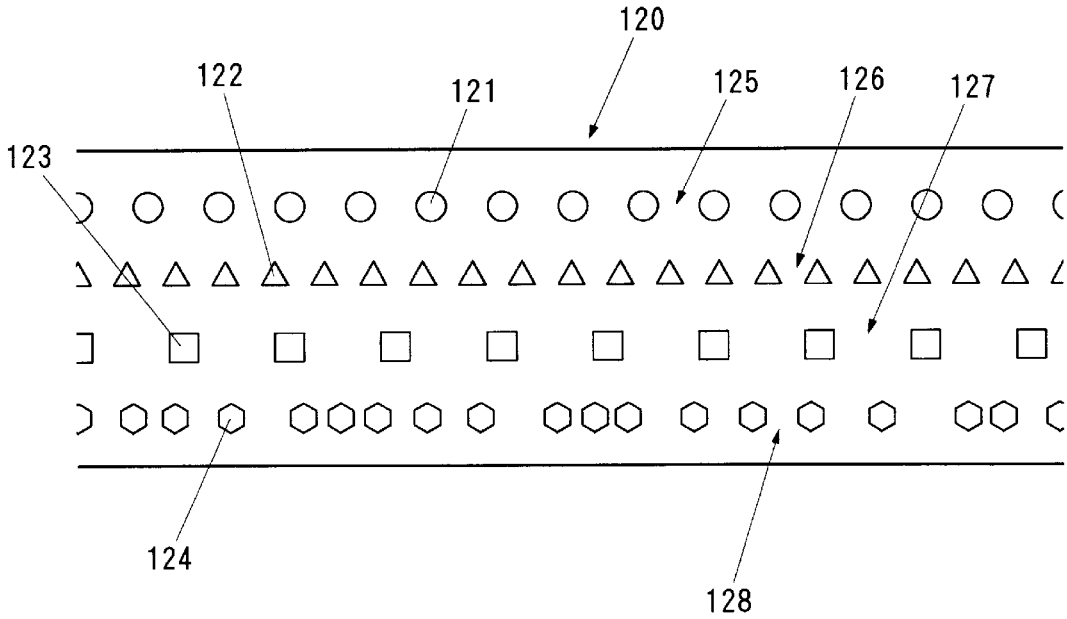
Figure 2:
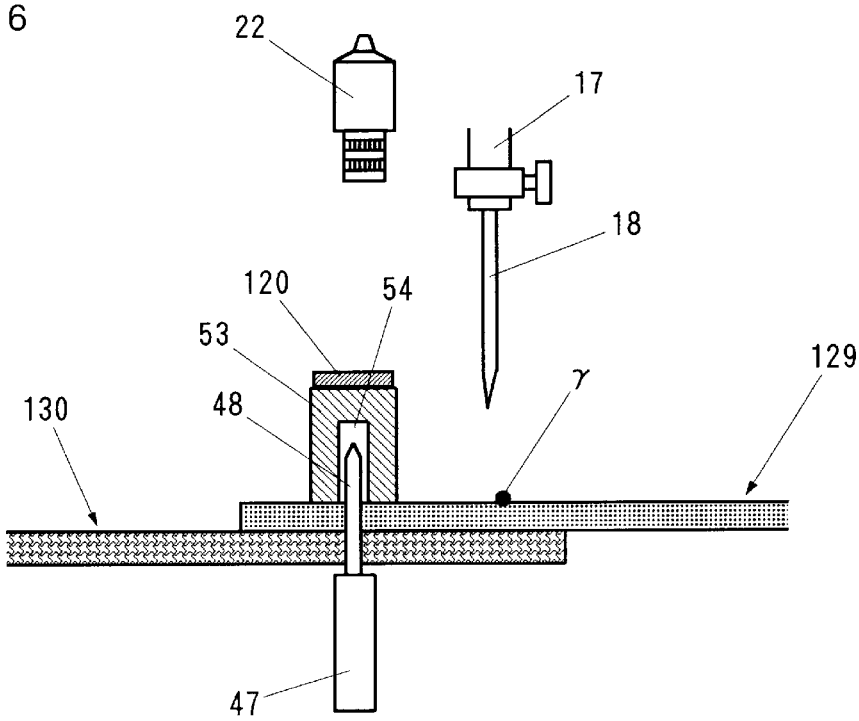
Figure 2:
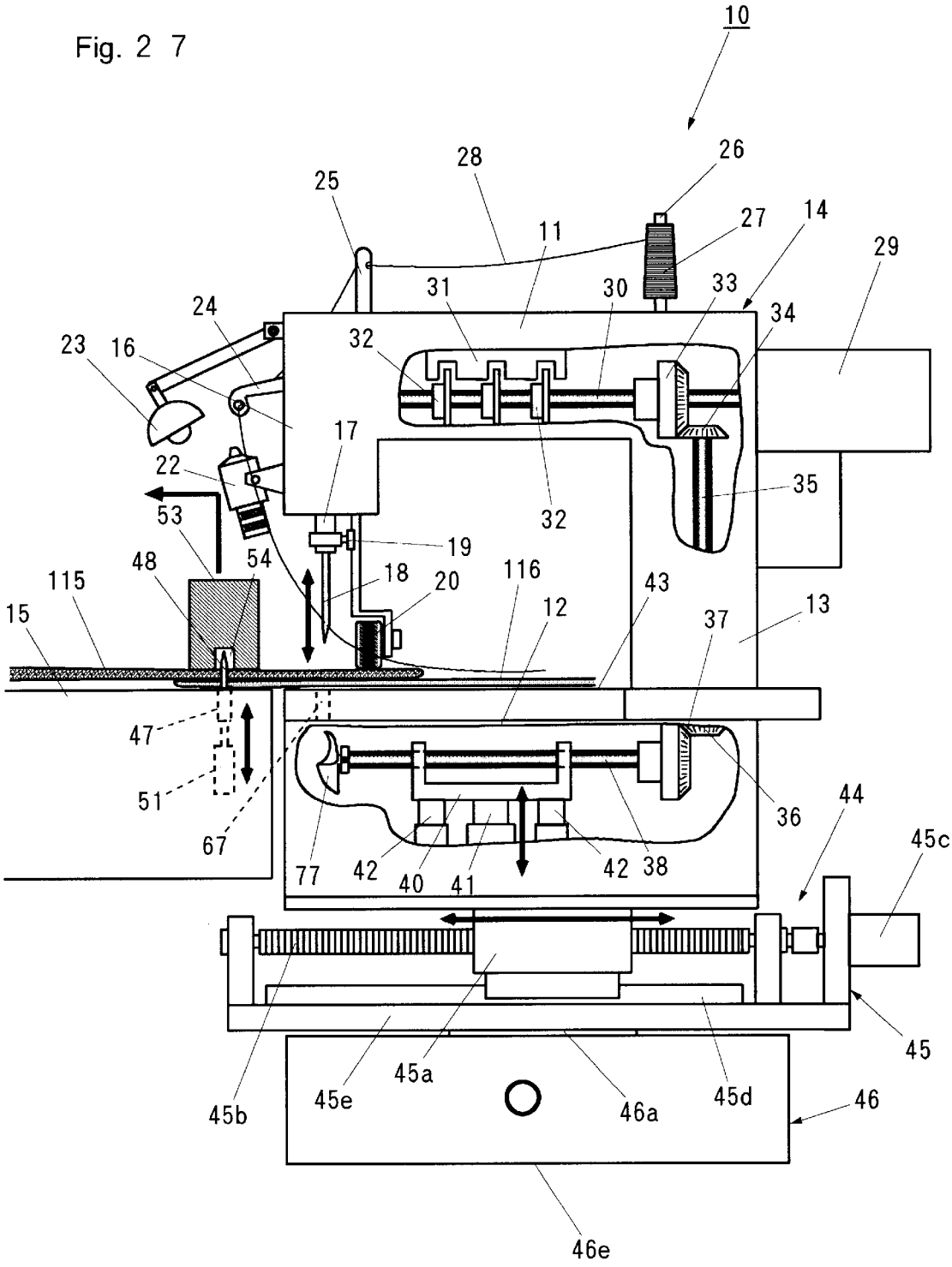
Figure 2:
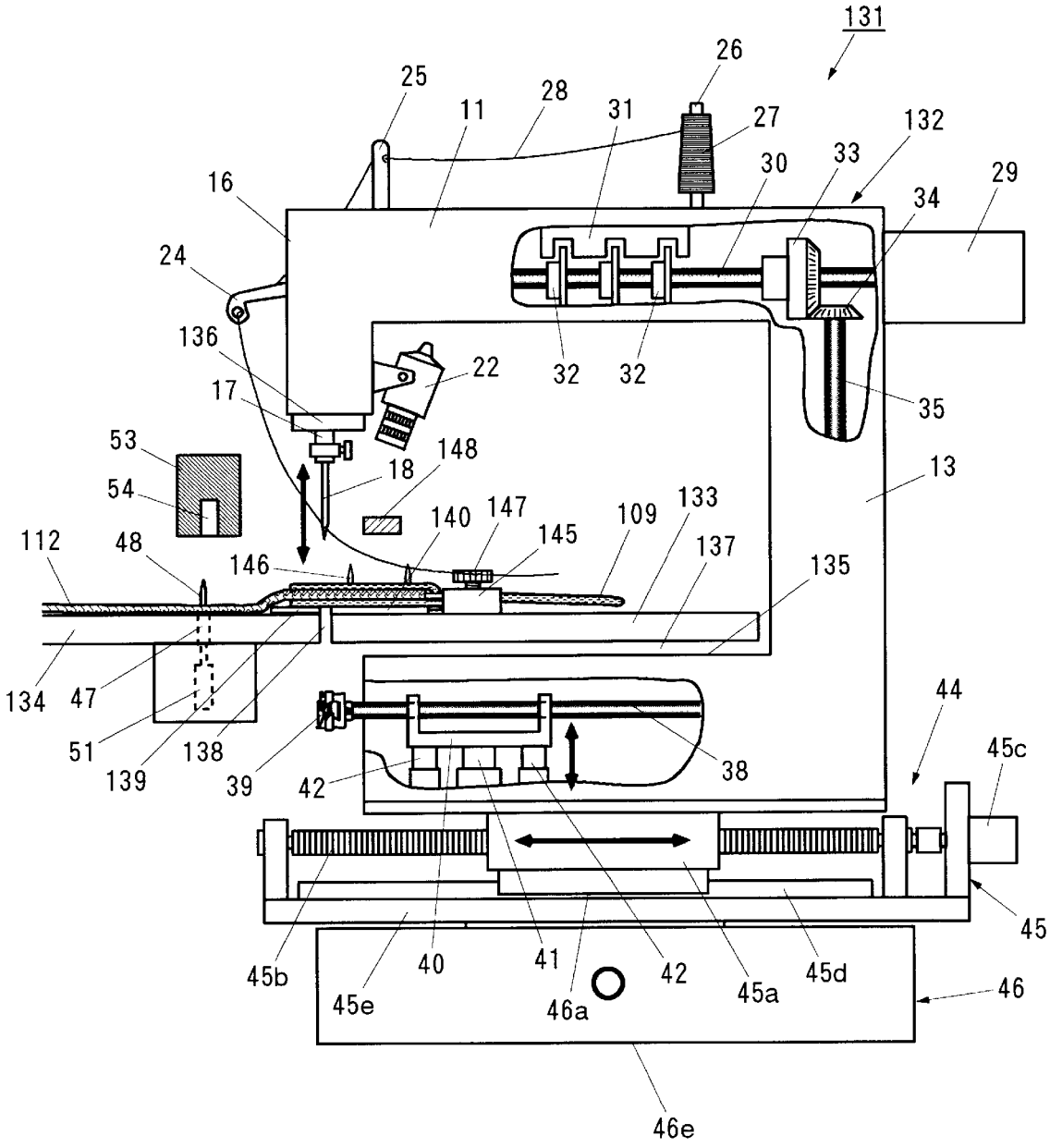
Figure 2:
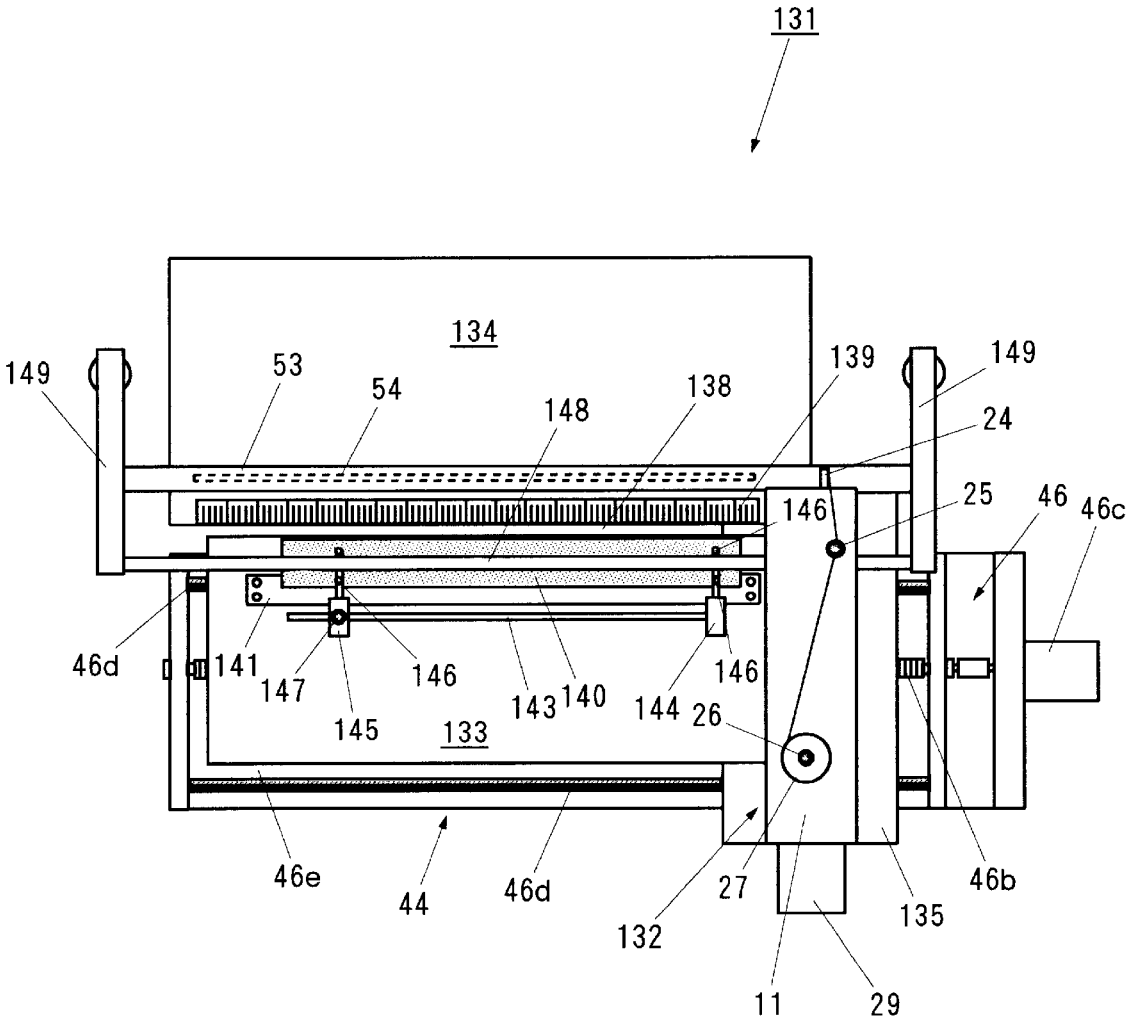
Figure 3:
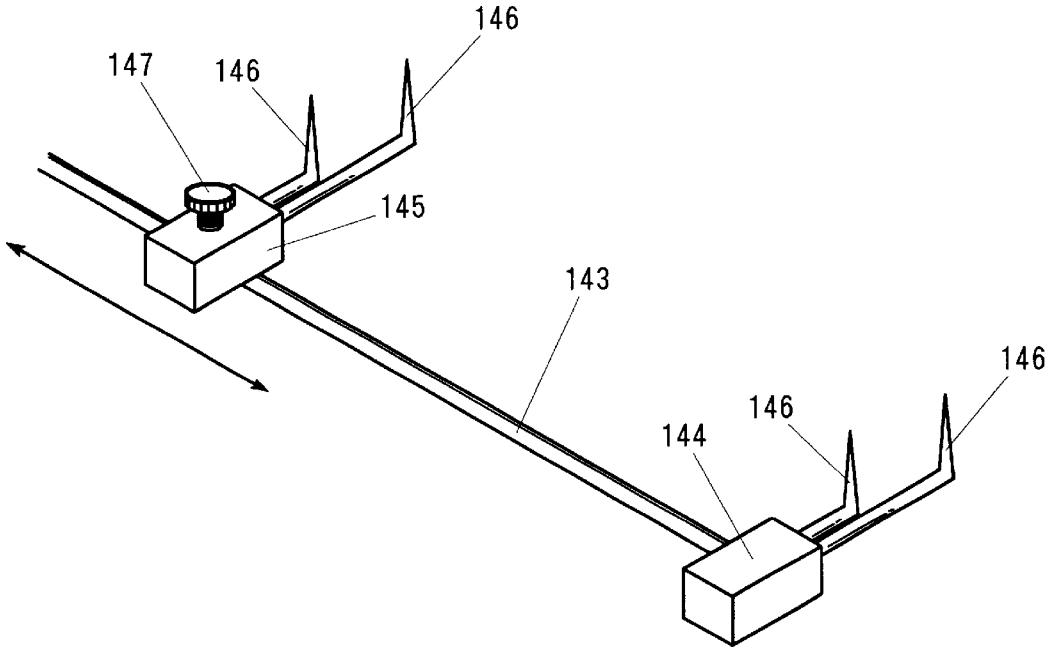
Figure 3:
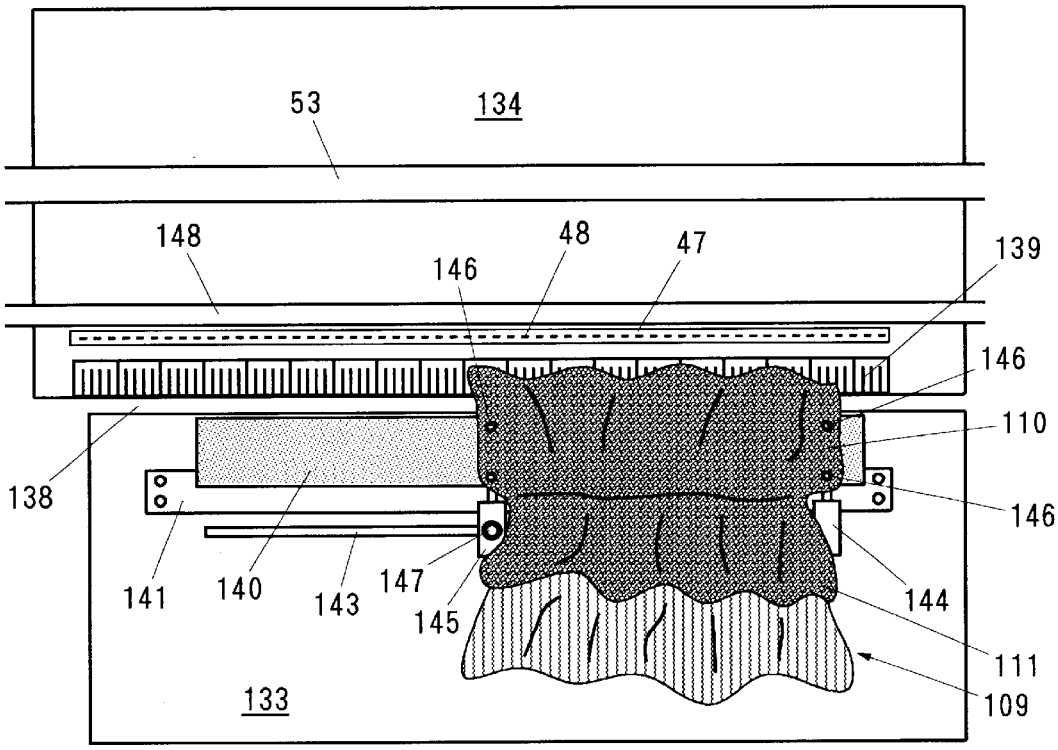
Figure 3:
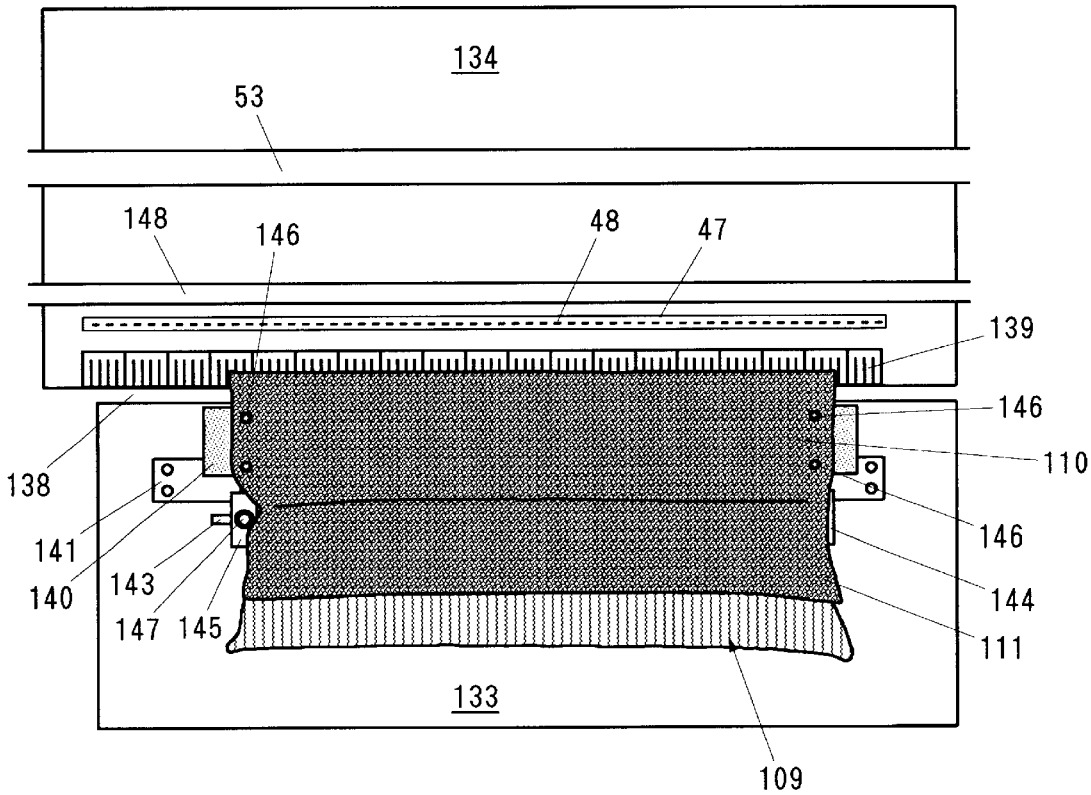
Figure 3:
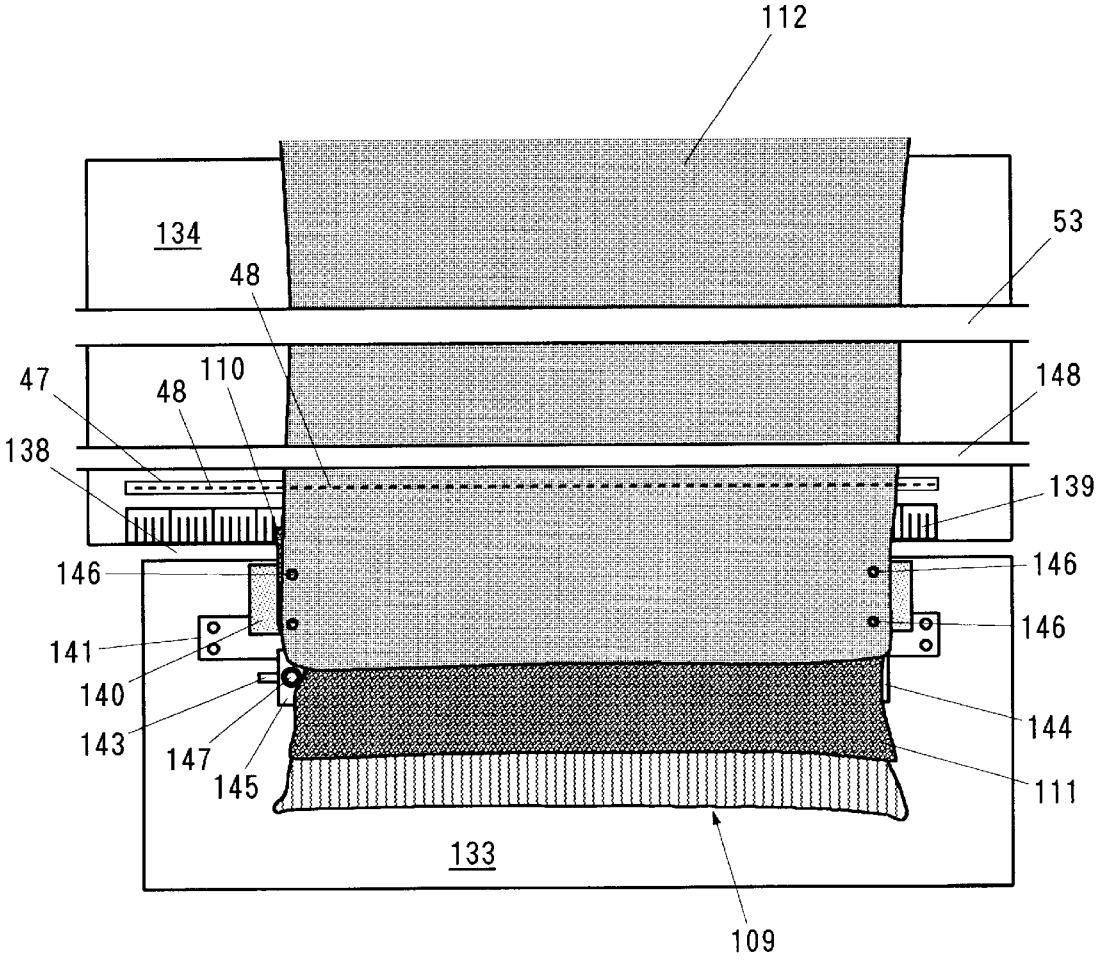
Figure 3:
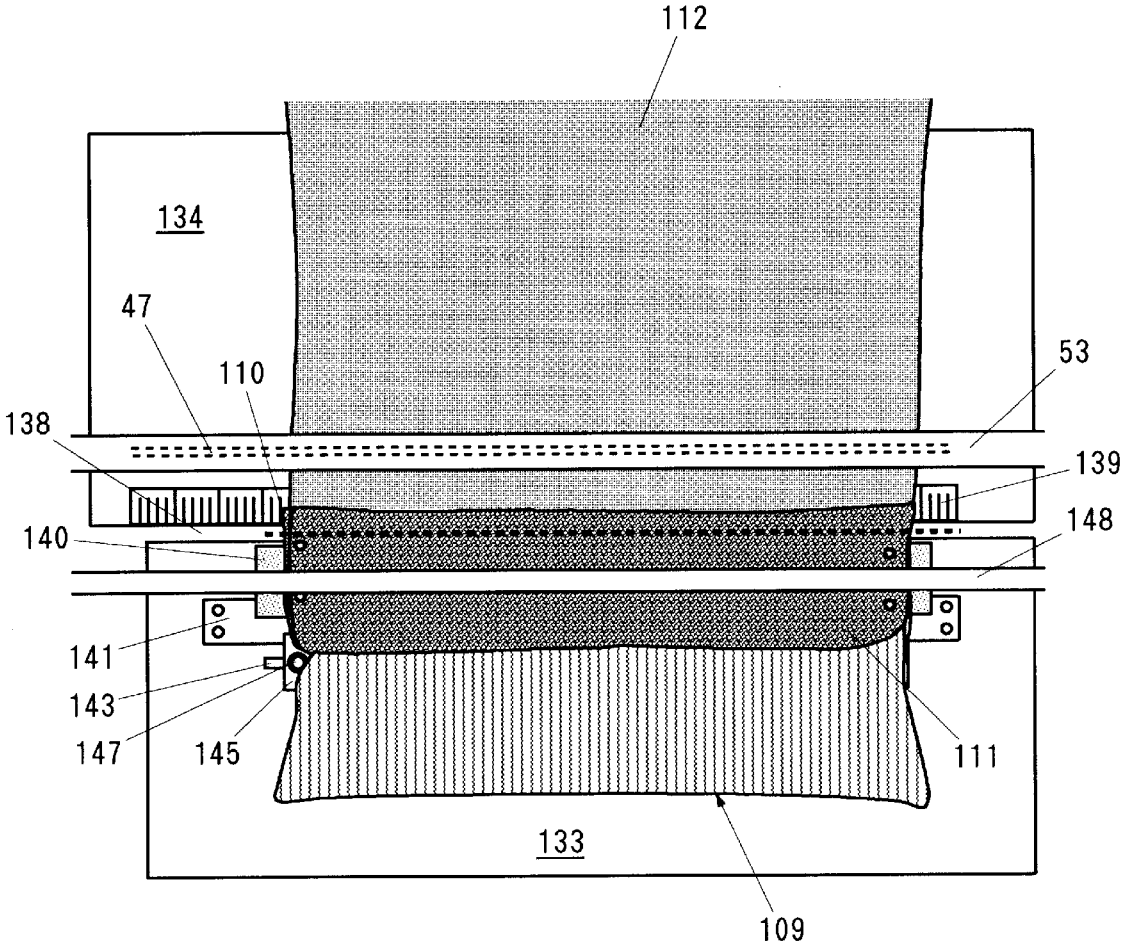
Figure 3:
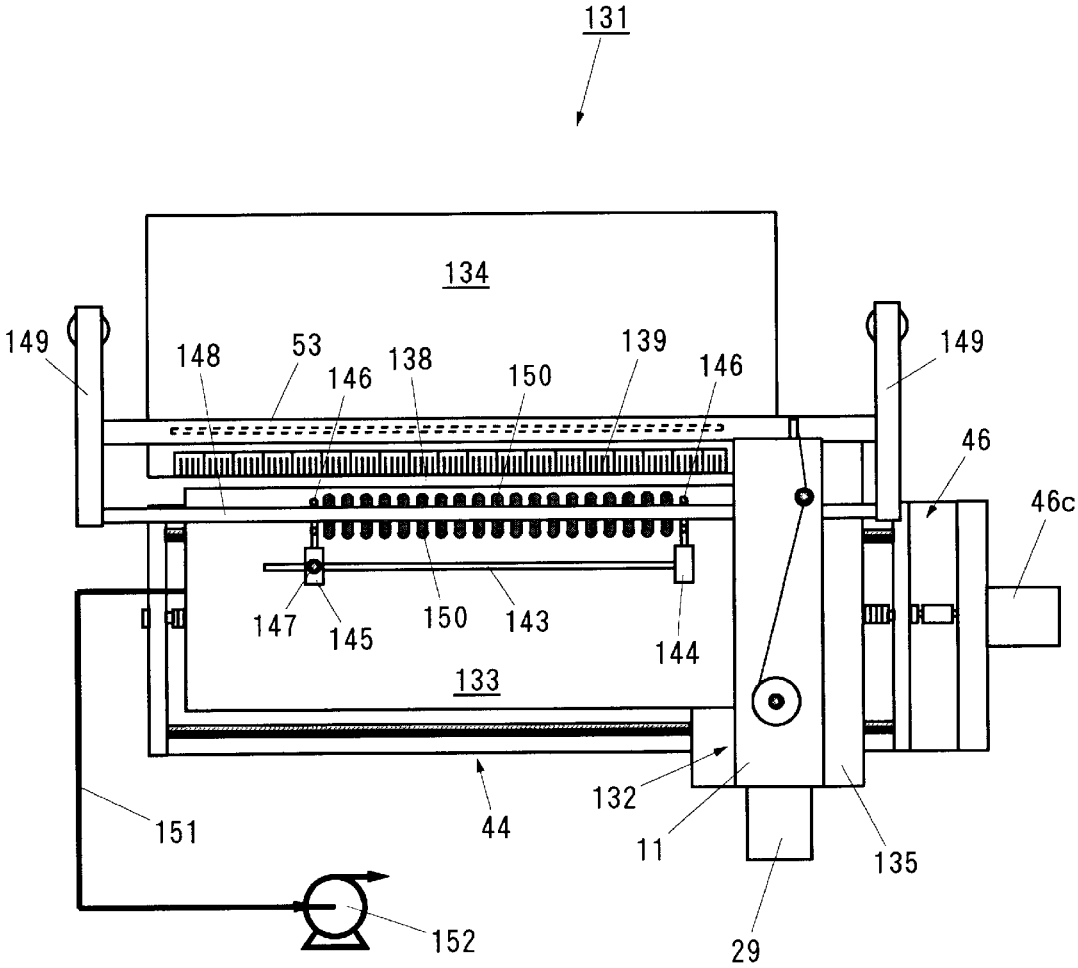
Figure 3:
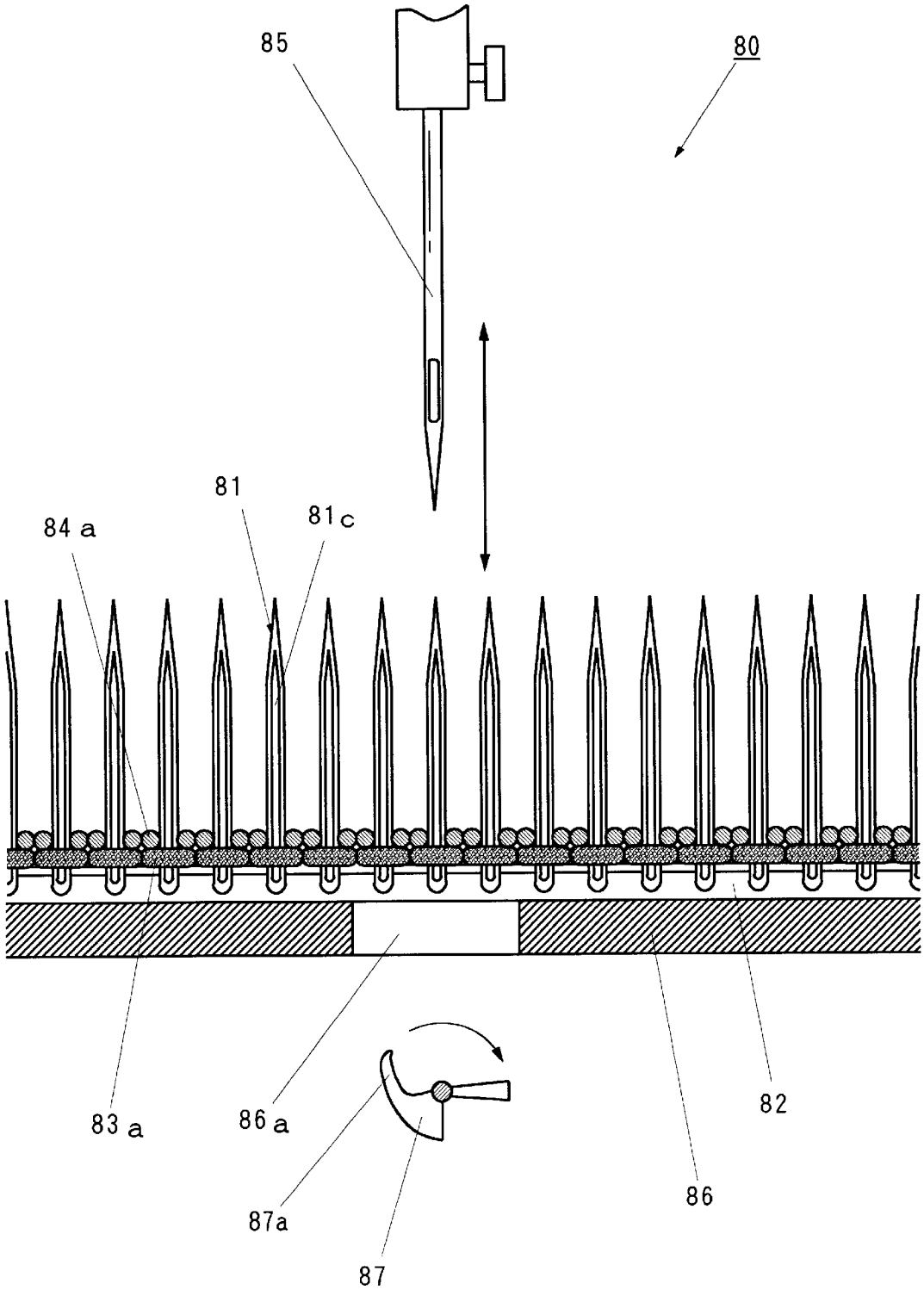
Figure 3:
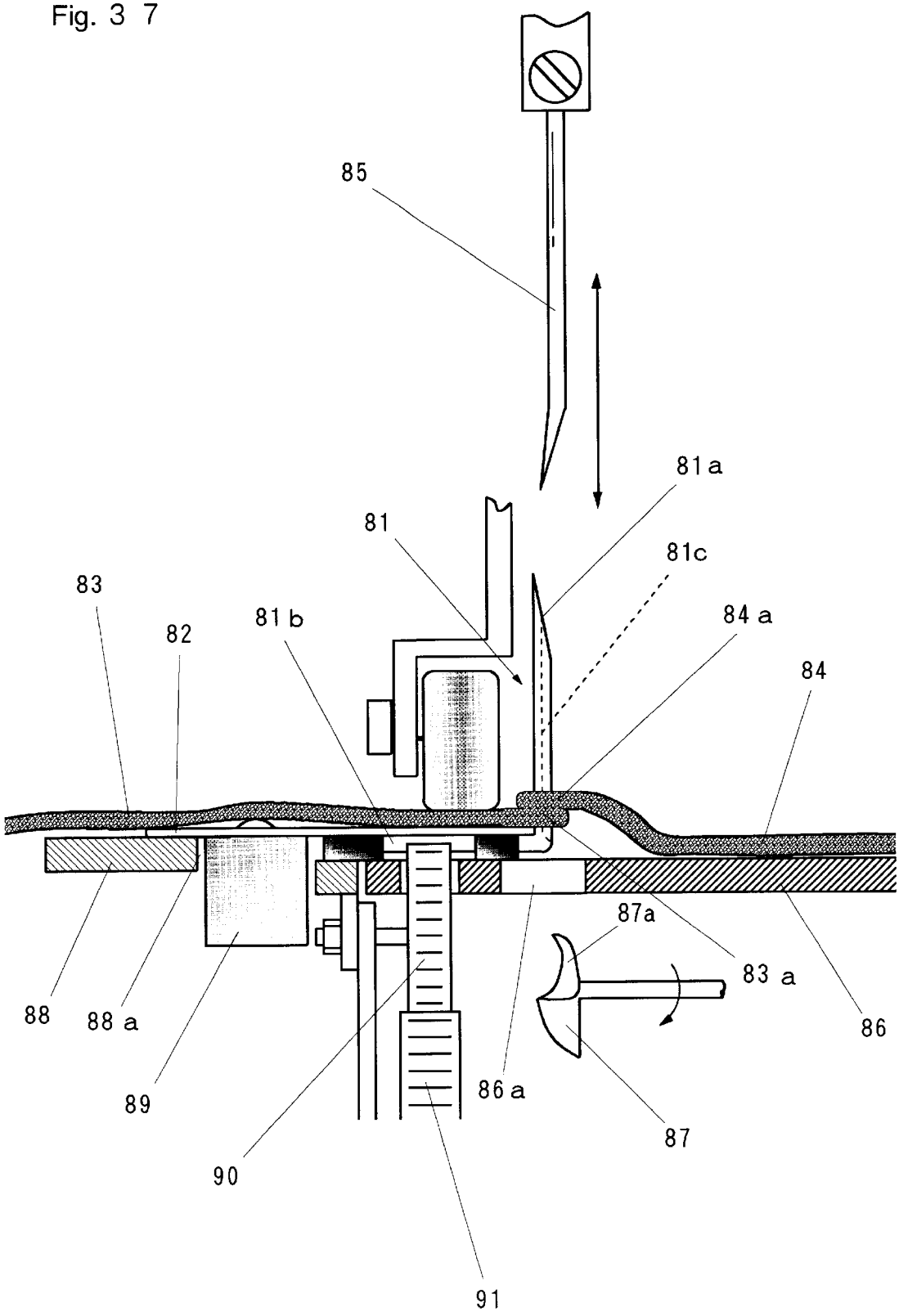
Figure 3:
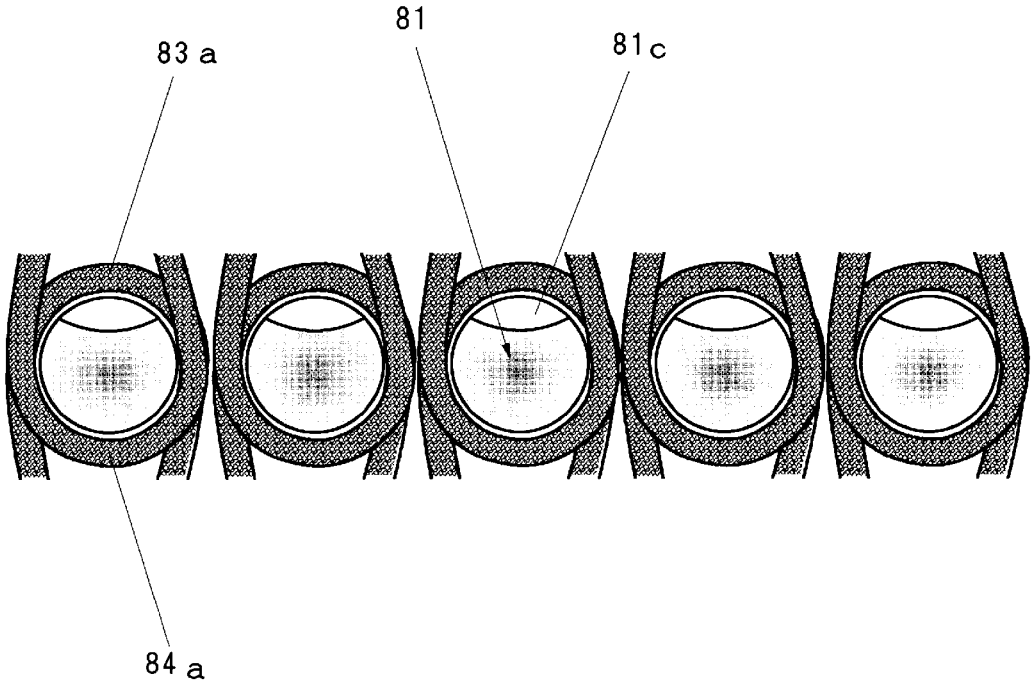
Figure 3:
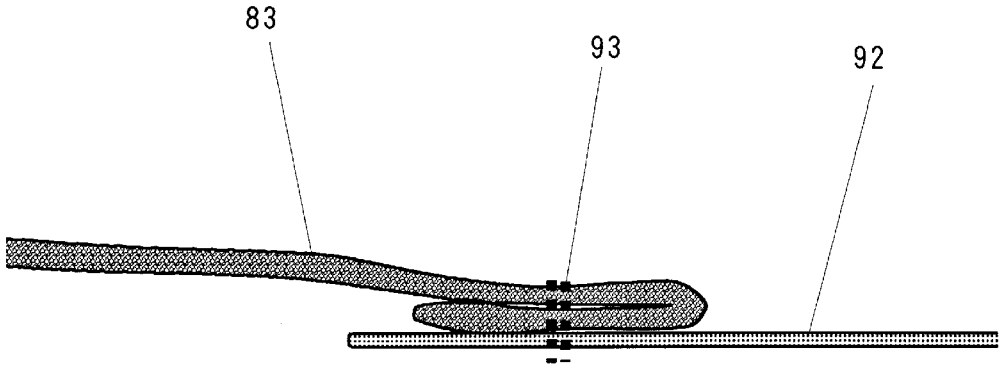

In order to solve this problem, it is effective to form as shown in FIG. 9 dummy patterns, which constitute guide marks, on a row of stitches immediately under the stitches α desired to be sewn, by knitting into a half course (one course in some cases) during the formation of the knitted fabric 21*b* one waste thread 68 having a loud color, such as an opponent color of the ground color of the knitted fabric 21*b* and prepared by immersing one raw waste thread in a predetermined resin solution (for example, a solution obtained by melting a fiber element resin in a solvent, such as alcohol) so that the waste thread can be clearly distinguished from that forming the knitted fabric 21*b;* and specify the stitches α to be sewn, by utilizing those guide patterns 69 as clues.

Concretely speaking, the console 59 is operated as an enlarged image projected on the monitor 58 through the CCD camera 22 is observed, to enclose a region, which involves even parts of left and right stitches, and which has in its center as shown in FIG. 10 one stitch of the guide patterns 69, which comprise the waste thread 68, with a search window 70 to designate the range of the shape to be detected.

A pattern window 71*a* is then put on a target stitch α within the search window 70 to designate the position of the stitch a to be sewn, on the basis of the stitch of the guide patterns 69.

FIG. 10 shows an example in which the stitch α positioned at an immediately upper side of an apex of a triangular stitch is set as a target.

The control unit 55 is adapted to sequentially extract the shape (substantially W-shaped) of the guide patterns 69 enclosed with the search window 70 from the image data fetched momentarily through the CCD camera 22, judge that the portion a little above the apexes of the guide patterns 69 is the position in which the stitch α exists, and then compute the coordinates thereof.

Since the waste thread 68 contains a resin, it is somewhat solidified, so that the stitches of the guide patterns 69 are formed substantially triangularly as mentioned above. A triangular pattern other than the guide patterns 69 formed by knitting the waste thread 68 does not exist in the knitted fabric 21*b* on which comparatively flexible, rounded loops are continuously arranged, and, moreover, the waste thread 68 is dyed in color antagonistic to the color of the yarn constituting the knitted fabric 21*b*. Therefore, the guide patterns 69 become very conspicuous, and can be imaged reliably by the CCD camera 22.

The guide patterns 69 are arranged so that the apexes of the triangularly shaped portions thereof are always positioned in the vicinity of the stitches α to be sewn. Therefore, when the sewing needle 18 is merely lowered toward a position above the apex of a guide pattern 69, the erroneous sewing of the stitch β which should not be sewn does not occur, and the stitches α can be sewn linearly.

Since the dummy guide patterns 69 are formed by knitting one waste thread 68 into a half course, it can be pulled out simply after the completion of the sewing operation, and the design of the knitted product is not spoiled.

When the knitted fabric 21*b* is cut off along a line X in FIG. 10 with the waste pieces thread removed, the loops 104 of the knitted fabric 21*b* can be arranged beautifully on the sewn portion as shown in FIG. 11. The portions of the knitted yarn which are among the loops 104 are combined with each other reliably at a seam 105 without any drop stitch.

In FIGS. 7–11, the illustration of the woven fabric 21*a*, the other object to be sewn is omitted for the purpose of having the sewing operation understood easily. It is needless to say that the above-described setting of the guide patterns 69 and automatic sewing operation are carried out in practice with the knitted fabric 21*b* and woven fabric 21*a* kept in a laminated state.

The stitch patterns originally include various kinds of stitches, such as a plain stitch (sheeting stitch), a rib stitch and a purl stitch, and the respective stitches are divided into face stitches and bottom stitches, the yarn being formed of various kinds of materials to various thicknesses. Accordingly, the sewing of various kinds of knitted fabrics is conceivable.

Concerning the formation of the guide patterns 69, it is desirable to use as the waste thread 68 a thread of such a material that has a small fluff length, and permits stitches formed of the thread to be recognized clearly and pulled out easily, and to knit the waste thread by plain knitting which is capable of forming stitches of the simplest and the most image-recognizable shape.

Any kind of thread may be used as long as it meets these conditions. In general, it is desirable that the waste thread 68 be formed of a thread of chemical fiber (for example, a thread of Puron, a commercial name), or a thread of mixed fiber of chemical fiber and natural fiber rather than a thread of natural fiber.

A stitch α positioned in the vicinity of the apex of a triangular guide pattern 69 is not necessarily set as a target to be sewn. For example, the sewing of fabrics is started at the opposite side, a stitch α' to be sewn can also be set (FIG. 10) by putting a pattern window 71*b* on a portion immediately under the apex of the guide pattern 69.

In short, this setting operation may be carried out so that the position of a stitch to be sewn can be identified by using the guide pattern 69 as a clue.

Since a thread which is not a regular thread, and which has been immersed in a solution of a predetermined resin and somewhat hardened, is used as a waste thread 68 for forming the guide patterns 69, it becomes possible to give a certain degree of constant shape to the guide patterns 69, have the contours of the guide patterns displayed sharply as compared with that of guide patterns formed by using a regular thread, and minimize the occurrence of deformation and expansion of the waste thread which causes the shapes of guide patterns 69 to vary. As a result, a rate of recognition of guide patterns of the CCD camera 22 can be remarkably improved.

When the guide patterns 69 are irradiated with the lamp 23 fixed to the outer surface of the head 16, they can be displayed more clearly, and the rate of recognition thereof can be further improved.

The color of the waste thread 68 is not limited to a color antagonistic to the color of the knitted fabric 21*b*, and some other color may be selected as long as it can be distinguished clearly from the color of the knitted fabric 21*b*.

A waste thread which has been immersed in a solution in which fluorescent paint and above-mentioned resin were dissolved may be selected as the waste thread 68, which is knitted into the portion of the fabric to form the guide patterns 69, and black light may be used as the lamp 23 fixed to the outer surface of the head 16, to irradiate the guide patterns 69.

When the guide patterns 69 comprising the fluorescent paint-containing waste thread 68 are thus irradiated with black light, the guide patterns 69 emit light and the contours thereof appear very clearly as shown in FIG. 12, so that the rate of recognition of the guide patterns of the CCD camera 22 can be improved.

Although a case where the waste thread 68 is knitted into the portion of the knitted fabric 21*b* which is left as a final product, and is pulled out after the sewing operation has been finished is described above, the present invention is not limited to this case.

When the knitted fabric 21*b* comprises as shown in FIG. 13 a portion (which will hereinafter be referred to as 'garment knitted portion 106') to be left as a final product, and a portion (which will hereinafter be referred to as 'waste knitted portion 107') knitted continuously from the garment knitted portion 106 and going to be thrown away after the sewing operation has been finished, the waste thread 68 may be knitted into the part of the waste knitted portion 107 which is close to the border thereof with the garment knitted portion 106, to form the guide patterns 69.

In this case, the waste thread 68 is also formed of a thread dyed in a color antagonistic to that of the knitted fabric or impregnated with fluorescent paint in the same manner as mentioned above, and knitted so that substantially triangular patterns are arranged continuously with a pitch corresponding to a distance between adjacent loops to be sewn.

In the case shown in FIG. 13, stitches α to be sewn are set above valley portions among the triangular patterns formed by the waste thread.

When the knitting yarn is pulled and loosened from an end of the waste knitted portion 107 after the stitches α have been sewn by operating the sewing machine body 14, the two fabrics can be sewn together with the loops 104 of the knitted fabric 21*b* arranged beautifully on the surface of the woven fabric 21*a* as shown in FIG. 14.

Since the portion between the loops 104, 104 is sewn up reliably along a seam 105 without any drop stitches as shown in the drawing, so that the garment knitted portion 106 does not start loosening even when the waste knitted portion 107 is pulled out and loosened as mentioned above.

In order to draw the diagrams conveniently, the garment knitted portion 106 and waste knitted portion 107 are drawn in the same patterns. In practice, the garment knitted portion 106 is provided with finer stitch patterns demanded as stitch patterns of a product, and a complicated combination of face stitches and bottom stitches, while the waste knitted portion 107 including the waste thread 68 is formed of the simplest plain stitches. The reasons for the matter reside in the necessity of improving the rate of recognition of guide patterns of the CCD camera 22 by simplifying to as great an extent as possible the shape of the stitches constituting the guide patterns 69.

When the above-described sewing system is used, a sewing operation can be carried out accurately by automatically capturing the stitches α to be sewn, owing to the operations of the CCD camera 22 as an image sensor, controller 55, storage 56, and first servomotor 29~third servomotor 46*c*. Therefore, it is unnecessary to carry out the operations, which are needed in a conventional sewing system of this kind, for thrusting the stitches accurately by the locking needles on the throat plate, this enabling the knitted fabric sewing operations to be carried out with a very high efficiency.

Moreover, since the waste thread 68 knitted as a thread for forming the guide patterns 69 is pulled out literally after the sewing operation has been finished, the knitting of the guide patterns can be done advantageously by keeping in mind the high capability only of the CCD camera 22 of recognizing images, irrespective of the stitch patterns peculiar to the knitted fabric 21*b*.

Therefore, the knitted fabric 21*b* (garment knitted portion 106) can be turned into a fabric of a high added value provided with a complicated texture organization (rib stitches, purl stitches, and a combination of a lot of face stitches and bottom stitches, etc.) without being restricted at all with respect to the design.

In order to image the stitches of the knitted fabric 21*b* simply by the CCD camera 22 without employing such guide patterns 69, the texture organization of the knitted fabric 21*b* is necessarily simplified by all means so as to prevent a recognition error.

In order to widen the range of application of such an epochal first sewing system 10 to as great an extent as possible, it is effective to take a new look at the conventional sewing procedure.

For example, when a turtleneck sweater is sewn by a conventional sewing system, both shoulder portions are sewn first with a front body and a rear body put together, and a neck portion is then sewn round, both sleeve portions being finally sewn.

In regard to this, a sewing procedure is proposed which comprises sewing first one shoulder portion 74*a* alone of a rear body 72 and a front body 73 together as shown in FIG. 15, then stretching an end portion 72*a* of the rear body 72 and an end portion 73*a* of the front body 73 in the opposite direction so as to extend a turtleneck portion 75 linearly, then sewing such a neck portion 76 as shown in FIG. 16 on the turtleneck portion 75 by using the first sewing system 10, thereafter sewing a remaining shoulder portion 74*b* and terminal end sections of the neck portion 76 together, and finally sewing sleeve portions on the resultant product.

In the conventional sewing system, both shoulder portions are sewn together first to complete a turtleneck portion, and the neck portion is then sewn on the turtleneck portion along a circumference thereof, so that the sewing operation becomes very difficult. When the sewing operation is carried out following this conventional procedure, the sewing system according to the present invention cannot be utilized effectively but, when something is done for the sewing method as mentioned above, a more efficient sewing operation can be attained by using the present invention.

When the neck portion 76 is sewn on the turtleneck portion 75 of the body, it is necessary that these portions be aligned with each other (set in agreement with each other with respect to sizes).

The body has a high flexibility, so that, when the turtleneck portion 75 is merely subjected to a forcible, linear stretching operation and set on the fixing needles 48, the lateral size thereof fails to agree with that of the neck portion 76.

Even when the size of a space between the end sections 72*a*, 73*a* of the turtleneck portion 75 is formally set in agreement with the lateral size of the neck portion 76, problems remain.

As shown in FIG. 17, even a sewing line 108 of a portion called a turtleneck portion 75 in a word has curved sections and nearly linear sections, and is divided into a plurality of regions depending upon the presence or absence, degrees of such curved sections. Therefore, when the neck portion 76 is laminated as it is on the temporarily linearly stretched turtleneck portion 75 and sewed together, there is the possibility that wrinkles occur in places around the curved portions when the turtleneck portion 75 is removed from the fixing needles 48 and restores its original shape.

To solve this problem, using the following method is effective.

For example, in the case where the length of the whole circumference of the turtleneck portion 75 and a total length of the neck portion 76 are 34 cm, it is assumed that the neck portion 76 can be sewed on the turtle neck portion 75 (FIG. 16 and FIG. 17) by curving the neck portion 76 successfully without causing wrinkles to occur when a 16 cm neck section ab is assigned to a region between AB of the turtleneck portion 75, a 6 cm neck section bc a region between BC, a 2 cm neck section cd a region between CD, a 2 cm neck section de a region between DE, a 2 cm neck section ef a region between EF, and a 6 cm neck section fg a region between FG.

In this case, marks Ma~Mg corresponding to the points A~G of the turtleneck portion 75 are drawn in chalk on a surface of the fixing needle throat plate 47 in advance as shown in FIG. 18. Of course, the distance between the marks Ma–Mb is set to 16 cm, the distance between the marks Mb–Mc and Mf–Mg 6 cm, and the distance between the marks Mc–Md, Md–Me and Me–Mf 2 cm.

One end section A (72*a*) of the turtleneck portion 75 is thrust onto a fixing needle 48*a* above the mark Ma put on the fixing needle throat plate 47, and then a joint section B of the rear body 72 and front body 73 onto a fixing needle 48*b* above the mark Mb. A starting point C of a first curved section of the front body 73 is thrust onto a fixing needle 48*c* above the mark Mc, a terminal end D of the first curved section a fixing needle 48*d* above the mark Md, a starting point E of a second curved section of the front body 73 a fixing needle 48*e* above the mark Me, a terminal point F of the second curved section a fixing needle 48*f* above the mark Mf, and the other end section G (73*a*) of the turtleneck portion 75 a fixing needle 48*g* above the mark Mg.

Finally, one end of the neck portion 76 is thrust onto the fixing needle 48*a* above the mark Ma with the other end thereof thrust onto the fixing needle 48*g* above the mark Mg, to forcibly lower the pressure member 53, and an automatic sewing operation using the first sewing system 10 is carried out in this condition.

When the sizes of the neck portion 76 are thus assigned to the regions of the turtleneck portion 75 on the basis of the marks Ma~Mg set in advance at required intervals on the fixing needle throat plate 47, wrinkles do not occur on the body even when an automatic sewing operation is carried out, so that the neck portion 76 can be sewn successfully in a curved manner.

Of course, during the sewing operation, the guide patterns 69 comprising the waste thread 68 knitted in the neck portion 76 in advance are imaged by the CCD camera 22, and stitches to be sewn are specified accurately, the portions among the stitches being sewn reliably. Accordingly, stitch loops of the neck portion 76 can be arranged beautifully on the section thereof which borders on the body.

This sewing method requires much time for aligning each region of the turtleneck portion 75 with the respective marks Ma~Mg put on the fixing needle throat plate 47 but the number of such regions is only several. Moreover, the stitches of the turtleneck portion 75 may not be thrust one by one in order onto the fixing needles 48, so that this alignment operation is not so troublesome operation.

A method of applying the first sewing system 10 according to the present invention to a sandwich sewing operation, such as a so-called piping neck sewing operation will now be described.

The piping neck sewing method is an operation for sewing a neck member of one knitted fabrics having a pair of end portions knitted out from one end thereof on a neck portion of a body as shown in, for example, FIG. 19, in which an end portion of the body 112 is inserted between the first and second end portions 110, 111 of the neck member 109, the two end portions 110, 111 and body 112 being then sewn in a skewering manner.

A case where a sewing operation is carried out by folding one planar knitted fabric in two, and inserting an end portion of a body 112 between first and second end portions which occur due to this folding operation is also included in the piping neck sewing operation.

Although, in such a case, the guide patterns 69 on the second end portion 111 positioned on an outer side can be imaged by the CCD camera 22, those 69 on the first end portion 110 positioned on an inner side cannot.

Therefore, when these end portions are sewed up as they are in a skewering manner by an automatic sewing method using an image processing device, the stitches of the second end portion 111 can be sewn accurately without dropping any stitch but the stitches of the first end portion 110 are sewn blindly, i.e., the stitches cannot be accurately picked up.

As a result, there is the possibility that, when a waste knitted section 113 of the first end portion 110 is loosened after the sewing operation has been finished, even a garment knitted portion 114 which should originally be left as it is over the seam starts loosening.

When the automatic sewing is done once from the side of the outer surface with the fabrics then reversed to repeat the same step, the sewing can, of course, be done with the stitches of the first end portion 110 captured accurately. Although this gives a solution to the problem of loosening of the garment knitted portion 114, two seams newly appear on the second end portion 111 positioned on the outer side. Moreover, one of the seams is formed without accurately capturing the stitches to appear unsightly, so that it greatly spoils the commercial value of the sewn fabrics as a knitted product.

According to the conventional techniques, the locking needles are thrust manually with a high accuracy into the stitches of the first and second end portions 110, 111, and the second end portion 111—body 112—first end portion 110 are sewn together at once. Therefore, the above-mentioned problems do not arise but an improvement of the productive efficiency cannot be expected.

Under the circumstances, a new sewing method which enables a piping neck fixing operation to be carried out by utilizing the first sewing system 10 according to the present invention will now be proposed.

The first sewing method has, as shown in FIG. 20, the steps of folding a second end portion 111 of a neck member 109, laminating a first end portion 110 and an end portion of a body 112 on each other and placing the laminated portions on a bed (not shown) and a table (not shown), and fixing the same by fixing needles 48 and a pressure member 53.

The guide patterns 69 knitted into an outer surface of the first end portion 110 are imaged by a CCD camera 22, and the first end portion 110 and the end portion of the body 112 are sewn automatically by a sewing needle 18.

The body 112 and neck member 109 are reversed, and the second end portion 111 is laminated on an outer side of the body 112 to put them in the condition shown in FIG. 19. The guide patterns 69 knitted into the second end portion 111 are imaged by the CCD camera 22, and the automatic sewing of the second end portion 111—body 112—first end portion 110 is executed.

When a waste knitted portion 113 is removed after the automatic sewing operation has been finished, two seams 105, 105 appear on the first end portion 110. Moreover, one of these seams is an incomplete seam in which the loops are not picked up but this portion is hidden inside the clothes, so that there is no possibility that it might spoil the commercial value of the sewn objects as a product.

Needless to say, only one seam appears on the second end portion 111 exposed to the outside of the clothes, which is not shown.

Since the first end portion 110 and body 112 are sewn twice, the obtainment of a secondary effect, i.e. an increase in a combining strength of the neck member 109 and body 112 can be expected.

A second sewing method has, as shown in FIG. 22, the steps of folding a second end portion 111 of a neck member 109, placing a first end portion 110 alone on a bed (not shown) of a sewing machine and a table (not shown), and fixing the first end portion by fixing needles 48 and a pressure member 53.

The guide patterns 69 knitted into an outer surface of the first end portion 110 are imaged by a CCD camera 22, and stitch loops of the first end portion 110 are sewn automatically by a sewing needle 18.

Thus, first, the stitch loops of the first end portion 110 are fixed firmly so as to prevent the loosening thereof.

The neck member 109 is then reversed, and an end portion of a body 112 is inserted between the second and first end portions 111, 110 to put them in the condition shown in FIG. 19. The guide patterns 69 knitted into an outer surface of the second end portion 111 are imaged by the CCD camera 22, and the automatic sewing of the second end portion 111—body 112—first end portion 110 is executed.

In this case, two seams 105, 105 appear (FIG. 21) on the first end portion 110 of the neck member 109, and only one seam on the second end portion 111, so that the commercial value of the sewn objects as a knitted product can be maintained.

This sewing method can also be applied to a sandwiching sewing operation other than the piping neck fixing operation. In short, this sewing method can be applied extensively to cases where objects in which an object to be sewn is sandwiched between a pair of knitted fabrics are sewn together.

For example, a case where a front vertical neck (fabric surrounding buttons and button holes) is sewn on a cardigan, etc., or a case where a reinforcing part is sewn on an opening of a pocket or a case where a slit portion (an opening of a side of the body) is sewn, etc. are included in these cases.

As shown in FIG. 23, even when a pair of laminated knitted fabrics (a first knitted fabric 115 and a second knitted fabric 116) are sewn together by using the first sewing system 10, the guide patterns 69 on the second knitted fabric 116 positioned on an outer side can be imaged by a CCD camera 22 but the guide patterns 69 on the first knitted fabric 115 positioned on an inner side cannot.

Therefore, when these knitted fabrics are sewn as they are by the automatic sewing system using the image processing device, the stitches of the second knitted fabric 116 can be sewn accurately without dropping any one stitch but the stitches of the first knitted fabric 115 are sewn blindly, i.e., the stitches cannot be picked up accurately.

Consequently, there is a possibility that, when a waste knitted portion 115*a* of the first knitted fabric 115 is loosened after the completion of the sewing operation, even a garment knitted portion 115*b* which should originally be left as it is over the seam starts loosening.

In order to solve this problem, it is effective to utilize the above-described second sewing method.

First, the first knitted fabric 115 alone is placed on a bed of a sewing machine and a table, and fixed thereon by fixing needles 48 and a pressure member 53.

The guide patterns 69 knitted into an outer surface of the first knitted fabric 115 are imaged by a CCD camera 22, and the stitch loops are sewn automatically by a sewing needle 18.

The stitch loops of the first knitted fabric 115 are thus back tuck sewn to secure the condition in which a sewn portion does not start loosening.

A second knitted fabric 116 is then laminated on the outer surface of this first knitted fabric 115, and the guide patterns 69 knitted into the second knitted fabric 116 are imaged by the CCD camera 22, the knitted fabrics being then automatically sewn.

After the sewing operation has been finished, waste knitted portions 115*a,* 116*a* of the first and second knitted fabrics are removed to attain a combination, in which seams are substantially inconspicuous, of a garment knitted portion 115*b* of the first knitted fabric and a garment knitted portion 116*b* of the second knitted fabric as shown in FIG. 24.

Two seams 105, 105 appear on inner surfaces of the first and second knitted fabrics 115, 116, while one seam appear on their respective outer surfaces, the seams on the first knitted fabric 115 being substantially inconspicuous and not causing the commercial value of the sewn objects as a knitted product to decrease.

When this sewing system is used, a pair of knitted fabrics can be sewn together without leaving a duplicated portion (sewing margin) behind. Accordingly, the sewing of such fabrics can be done with the seams formed substantially inconspicuously, so that this sewing system is optimumly applied to the sewing of a toe portion and a heel portion of a sock, and the jointing of a hem and linking of a shoulder of a sweater, etc.

In the above description, examples in which this first sewing system 10 is used for the sewing of a woven fabric and a knitted fabric and the sewing of knitted fabrics are referred to, and this sewing system can also be used for the sewing of non-stitch-carrying woven fabrics.

In this case, a pair of woven fabrics may be placed on a table 15 with a fixing needle throat plate 47 lowered, and fixed thereon by lowering a pressure member 53 alone without lifting the fixing needle throat plate 47.

When a fixing needle throat plate 47 provided with such very thin fixing needles 48 that do not cause a scratch to be left on the woven fabrics is used, the woven fabrics may be fixed on the table by lifting the throat plate 47 and thrusting the fixing needles 48 into the fabrics.

When woven fabrics are sewn together, a waste thread forming guide patterns cannot be knitted thereinto in advance but a plate 120 displaying guide patterns on an outer surface thereof as shown in FIG. 25 can be used.

On this plate 120, figures, such as circles 121, triangles 122, quadrangles 123 and hexagons 124 are displayed continuously in the lateral direction at predetermined intervals, and different figures form different guide patterns.

The intervals of first guide patterns 125 formed of the continuously arranged circles 121 are set larger than those of second guide patterns 126 formed of the continuously arranged triangles 122, and smaller than those of third guide patterns 127 formed of the continuously arranged quadrangles 123. The fourth guide patterns 128 formed of the continuously arranged hexagons 124 have irregular intervals.

As shown in FIG. 26, this plate 120 is provided in a position in the vicinity of woven fabrics 129, 130, objects to be sewn, for example, on an upper surface of the pressure member 53.

When, for example, the first guide patterns 125 formed of continuously arranged circles 121 are traced by the CCD camera 22 disposed above the plate 120 with coordinates which are spaced from the circles 121 by a predetermined distance set in advance as portions $\gamma$ to be sewn, the automatic sewing of the woven fabrics can be done at intervals that are identical with those of the first guide patterns 125.

In order to change intervals of the sewing operation, the sewing system may be set so that some other guide patterns formed of triangles 122 or quadrangles 123 are traced by the CCD camera 22.

When an irregular intervals of sewing operation is required, the sewing system is set so that the fourth guide patterns 128 formed of the hexagons 124 are traced by the CCD camera 22.

It is, of course, possible to set intervals of sewing operation by inputting a suitable interval directly from ten keys or a keyboard instead of setting it by reading the guide patterns on the plate 120 by such a CCD camera 22.

As shown in FIG. 27, the above-described sewing machine body 14 may be formed by using instead of the shuttle 39 the same wedge type looper 77, attached to a free end portion of a lower shaft 38, as that referred to in the above description of a conventional sewing system and, to sew together the first and second knitted fabrics 115, 116, objects to be sewn, by forming a chain seam.

This looper 77 is adapted to be rotated in a predetermined direction synchronously with vertical movements of a sewing needle 18, capture at its tip a sewing thread 28 carried thereto by the sewing needle 18 to form a loop, retain the loop until the sewing needle 18 is subsequently lowered, and pass a subsequent sewing thread 28 carried thereto by the sewing needle 18, through the loop to form a chain seam and thus sew the knitted fabrics 115, 116 together.

Since the construction of this sewing machine body is not basically different from the above-described mode of embodiment except in that the looper 77 instead of the shuttle 39 is attached to the free end portion of the lower shaft 38, the descriptions of equivalent parts will be omitted by adding the same reference numerals thereto.

The first sewing system 10 is formed so that the sewing needle 18 and the stitches to be sewn are aligned with each other by moving the sewing machine body 14 in the X–Y directions. It may also be formed so that this alignment is effected by moving the objects to be sewn, i.e. the table 15 in the X–Y directions. It is also possible to move the sewing machine body 14 in any one of the X–Y directions, and move the table 15 in the other direction.

It is also possible to sew the objects while sending out the objects to be sewn, in order toward the sewing machine body 14 by hand or by a cloth feed mechanism provided on the table instead of sewing the objects fixed on the table 15 while moving the sewing machine body 14 along the table 15 by the X–Y table 44. In this case, the sewing machine body 14 is moved in the X–Y directions only for aligning (fine adjustment) the sewing needle 18 and stitches to be sewn, with each other.

This alignment operation may also be carried out by using a table of a circular shape and a fixing needle throat plate and a pressure member which are bent along the circumference of the table, fixing objects to be sewn, on the table along the circumference thereof, and rotating the circular table or moving the sewing machine body along the circumference of the table.

FIGS. 28 and 29 show a second sewing system 131 according to the present invention.

The second sewing system 131 is provided with a sewing machine body 132, a first setting table 133, and a second setting table 134.

The construction of the sewing machine body 132 is substantially identical with that 14 of the first sewing system 10. Namely the sewing machine body 132 is provided with an arm 11, a sewing machine bed 135 parallel to the arm 11, and a post 13 connecting the arm 11 and bed 135 together.

The arm 11 is provided at a front end portion thereof with a head 16, from a lower end portion of which a needle bar 17 projects, a sewing needle 18 being fixed to a free end portion of the needle bar 17.

A CCD camera 22 is fixed to a rear surface of the head 16.

A ring-shaped black light 136 is fixed to a free end portion of the head 16.

A balance 24 projects from a front surface of the head 16.

A thread support bar 25 and a bobbin holder 26 are erected on an upper surface of the arm 11, and a bobbin 27 is fitted around the bobbin holder 26. A needle thread 28 for sewing objects which is sent out from the bobbin 27 is inserted through a hole of the sewing needle 18 via through holes of the thread support bar 25 and balance 24.

A first servomotor 29 is fixed to a rear end surface of the arm 11.

A driving shaft of the first servomotor 29 is joined to an upper shaft 30 provided laterally in the interior of the arm 11.

The arm 11 is further provided therein with a rotation sensor 31 for detecting a rotational speed and a rotational frequency of the upper shaft 30. This rotation sensor 31 is provided with a light-emitting element and a light receiving element, and adapted to detect the condition of the upper shaft 30 by having the light receiving element catch the light emitted by the light-emitting element, passed through slits of discs 32 mounted on an intermediate portion of the upper shaft 30.

The upper shaft 30 contains a crank mechanism (not shown) in a front end portion thereof, and a rotational movement of the upper shaft 30 is converted into vertical movements of the needle bar 17 via this crank mechanism.

The upper shaft 30 is mounted at its rear end portion with a first bevel gear 33, which is meshed with a second bevel gear 34. The second bevel gear 34 is mounted on an upper end portion of a transmission shaft 35 provided vertically in the post 13. The transmission shaft 35 is mounted at its lower end portion with a third bevel gear (not shown) in the same manner as that in the sewing machine body 14 of the above-described first sewing system 10, and this third bevel gear is meshed with a fourth bevel gear.

The fourth bevel gear is joined to a rear end of a lower shaft 38 provided laterally in the bed 135. The lower shaft 38 is mounted at its front end portion with a fully rotatable shuttle 39.

A driving shaft of an air cylinder 41 is joined to a lower surface of a bearing member 40 supporting the lower shaft 38, and the lower shaft 38 together with the shuttle 39 can be moved vertically along guide members 42, 42 by vertically moving the driving shaft of the air cylinder 41. When the lower shaft 38 is moved to the uppermost position, the fourth bevel gear is meshed with the third bevel gear, and, when the lower shaft 38 is moved to the lowermost position, the fourth and third bevel gears separate from each other.

Owing to this arrangement, when the upper shaft 30 is rotated by driving the first servomotor 29, the needle bar 17 and sewing needle 18 start moving up and down, and the rotation of the upper shaft 30 is transmitted at the same time to the lower shaft 38 via the transmission shaft 35, so that the lower shaft 38 and shuttle 39 are also rotated. Namely, a rotational movement of the shuttle 39 is effected synchronously with the vertical movements of the sewing needle 18.

The sewing machine body 132 is placed and fixed on an upper surface of an X–Y table 44.

A first table 133 is provided above an upper surface of the bed 135 of the sewing machine body 132. Between a lower surface of the first table 133 and the upper surface of the bed 135 of the sewing machine, a clearance 137 of a predetermined height is secured.

The sewing machine body 132 is rendered movable in the direction perpendicular to the axis of the first table 133 by an X-axis feed mechanism 45 for the X–Y table 44, and in the lateral direction along the first table 133 by a Y-axis feed mechanism 46.

Since the construction of the remaining portion of the X–Y table 44 is substantially identical with that of the corresponding portion of the X–Y table 44 of the above-described first sewing system 10, a further description will be omitted.

The first and second tables 133, 134 are disposed and fixed in positions of a substantially equal height, and a clearance (needle path 138) through which the sewing needle 18 passes is formed between the two tables.

A measuring member 139 extending along the needle path 138 is provided on an upper surface of the second table 134, and an upper surface of the measuring member 139 is graduated for measuring a length of an object to be sewn.

A fixing needle throat plate 47 is provided on the upper surface of the second table 134, and has a plurality of fixing needles 48 just as the fixing needle throat plate shown in FIG. 4 or 18.

The fixing needle throat plate 47 in the second sewing system is provided so that it can be moved vertically by an operation of an air cylinder 51 or a solenoid, etc. When the fixing needle throat plate 47 reaches the highest position, the fixing needles 48 project from the upper surface of the second table 134, and, when the fixing needle throat plate 147 reaches the lowest position, the fixing needles 48 retract completely within the second table 134.

A pressure member 53 is provided on the upper surface of the second table 134. This pressure member 53 is formed by comparatively elongated angular metal materials.

The pressure member 53 is provided in the lower surface thereof with a longitudinally extending groove-like recess 54, which has so large a depth that permits the fixing needles 48 fully projecting from the surface of the table 15 to be stored completely therein.

A rectangular firmly fixable plate 140 is provided on the upper surface of the first table 133 so as to extend along the needle path 138. One end side of this firmly fixable plate 140 is joined to a fixing plate 141 secured detachably to the upper surface of the first table 133 with the screws. The fixable plate 140 comprises a material having a predetermined level of surface adhesiveness, such as vinyl or rubber.

The upper surface of the first table 133 is provided with a slide groove 143 which is parallel to the needle path 138. At one end portion of this slide groove 143, a stationary fixing member 144 is provided. A movable fixing member 145 is slidably engaged with the slide groove 143. These stationary fixing member 144 and movable fixing member 145 are combined with each other to function as a stretch-fixing means.

As shown in FIG. 30, a pair of L-shaped locking needles 146, 146 projects at an interval of a predetermined distance from the stationary fixing member 144 toward the fixable plate 140. A pair of locking needles 146, 146 also projects in the same manner from the movable fixing member 145 toward the fixable member 140.

A locking screw 147 is screwed on the upper surface of the movable fixing member 145. The movable fixing member 145 is fixed in an arbitrary position in the slide groove 143 when this locking screw 147 is tightened, and become slidable when the locking screw 147 is loosened.

Above the first table 133, a bar type holding member 148 parallel to the pressure member 53 is disposed. The holding member 148 and pressure member 53 are combined with each other by connecting members 149, 149.

The connecting members 149, 149 are disposed so that they can be moved vertically and longitudinally by a suitable driving unit, such as an air cylinder (not shown) or a solenoid (not shown).

The construction referred to in the description of the first sewing system 10 can be applied as it is or by making corrections thereon to this second sewing system 131 as well except in a case where the construction is definitely contradictory to that of the second sewing system.

For example, this second sewing system is also provided with a control mechanism (i.e. a control unit 55, a storage 56 comprising a ROM 56*a* and a RAM 56*b*, an image controller 57 for a CCD camera 22, a monitor 58, and a console 59, etc.) identical with that disclosed in FIG. 5.

Figure 6:
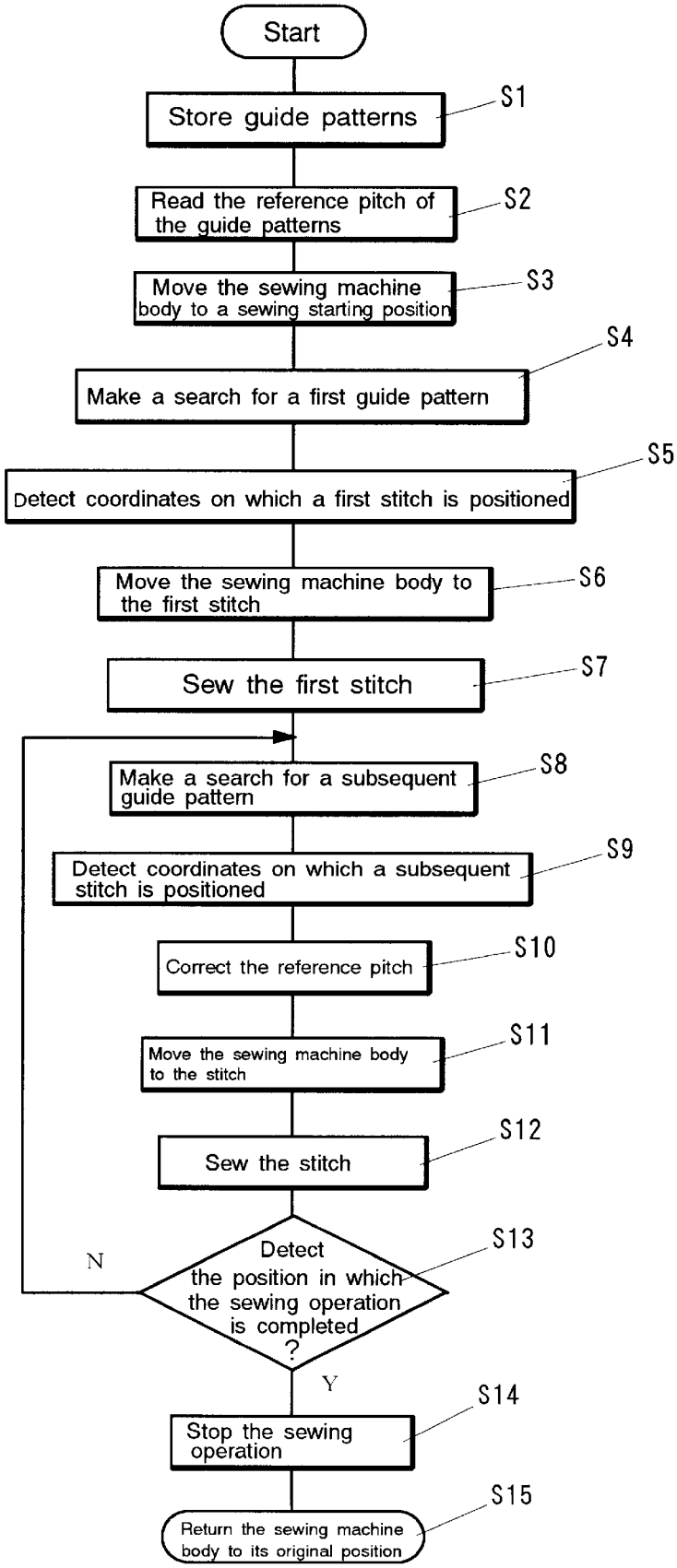
FIG. 6 is a flow chart showing basic actions of the sewing system.

The basic operation of the second sewing system 131 and that of the first sewing system 10 described in the flow chart of FIG. 6 have same points.

The method of forming guide patterns 69 on the objects to be sewn is also applied as it is to the sewing system 131.

An automatic sewing method utilizing the control unit 55, and comprising detecting a position of a stitch $\alpha$ to be sewn, by the CCD camera 22 on the basis of the guide patterns 69, computing a difference between the position of the stitch and that of the sewing needle 18 in the sewing machine body 132, and moving the sewing machine body 132 in the X–Y directions so as to eliminate the difference, is also applied to the second sewing system 131.

The procedure for setting a neck member 109 (piping neck) as an object to be sewn and a body 112 on first and second tables 133, 134 is explained with reference to FIGS. 31–34. In order to conveniently show the procedure, illustrations of the sewing machine body 132 and X–Y table 44 are omitted in FIGS. 31–34.

First, as shown in FIG. 31, one edge section of a first end portion 110 of the neck member 109 is pressed against the locking needles 146, 146 of the stationary fixing member 144 on the first table 133, while the other edge section is pressed against the locking needles 146, 146 of the movable fixing member 145. During this time, the pressure member 53 is sent away to a position at the back of the second table 134 so that it does not interfere with a sewing operation. The holding member 148 is also sent away to the side of the second table 134 for the same purpose.

The movable fixing member 145 is then moved in the opposite direction (leftward) along the slide groove 143 as shown in FIG. 32. When the first end portion 110 of the neck member 109 has been stretched to attain a predetermined length, the movable fixing member 145 is fixed by tightening the locking screw 147. A substantial length to which the neck member should be stretched is determined with reference to the graduations on the measuring member 139 provided on the second table 134.

A turtleneck portion of the body 112 is then put from the side of the second table 134 over the first end portion 110 as shown in FIG. 33, and the locking needles 146, 146 of the stationary fixing member 144 and movable fixing member 145 are thrust into both edge sections thereof. During this time, the aligning (setting of the size) of the regions of the turtleneck portion and corresponding regions of the neck member 109 with each other is done by utilizing the measuring member 139 provided on the second table 134.

The second end portion 111 of the neck member 109 is then put over the turtleneck portion of the body 112, and the locking needles 146, 146 of the stationary fixing member 144 and movable fixing member 145 are then thrust into both edge portions thereof as shown in FIG. 34.

At this point in time, the pressure member 53 and holding member 148 are moved forward, and then lowered. Consequently, a plurality of fixing needles 48 are thrust into the body 112 in a skewering manner, and pressed and fixed from the upper side by the pressure member 53. The section of the fabrics in which the first end portion 110 of the neck member 109, turtleneck portion of the body 112 and second end portion 111 are laminated is pressed and fixed by the holding member 148.

After the neck member 109 and body 112 have thus been set on the first and second tables 133, 134, an automatic sewing operation using the CCD camera 22 is carried out as the sewing machine body 132 is moved to left along the needle path 138.

In this case, the guide patterns 69 are formed in advance on the upper surface of the second end portion of the neck member 109 as a matter of course.

It is also natural that the first end portion 110 has been subjected to back tuck sewing in advance.

In this second sewing system 131, an object to be sewn can be stretched by sliding the movable fixing member 145 after both edge portions of the object have been hung on the locking needles 146, 146 of the stationary fixing member 144 and movable fixing member 145 as mentioned above. Accordingly, the setting of objects to be sewn having an expansibility, such as knitted fabrics can be done easily.

The measuring member 139 provided on the second table 134 makes it possible to easily control an amount to which an object to be sewn is to be stretched, and also to set the position (size) of the object to be sewn with respect to another.

Moreover, the laminated section of the objects to be sewn are pressed from the upper side by the pressure member 148, and the slipping of the lowermost layer (first end portion 110 of the neck member 109) of the laminated section can be prevented owing to the presence of the fixable plate 140, this enabling the portions to be sewn to be stabilized.

The material for the fixable plate 140 is not limited to special vinyl and rubber. Any material can be used as long as it can prevent (has a high friction coefficient) the slipping of the objects to be sewn. For example, a face fastener is usable for the purpose.

When the automatic sewing operation is carried out a certain number of times by using the fixable plate 140, fine chips of the objects being sewn are deposited on an upper surface thereof, and the fixing performance gradually lowers.

In such a case, the screws on the fixing plate 141 may be removed, then the fixing plate 141 together with the fixable plate 140 may be replaced. Even when the fixing performance of the fixable plate 140 formed out of vinyl or rubber or the like has once decreased, it can be restored to its original level by cleaning the fixable plate, and the fixable plate can be used repeatedly any number of times.

FIG. 35 shows a modified example of the second sewing system 131. This modified example employs a system for preventing the slippage of the objects to be sewn, by utilizing an air suction force instead of using the fixable plate 140.

Namely, a hollow (not shown) is formed in a first table 133, and a plurality of suction ports 150 communicating with the hollow are formed at predetermined intervals in an upper wall thereof.

A suction unit 152 communicating with the hollow via a suction pipe 151 is joined thereto.

When the suction unit 152 is operated after the objects to be sewn have been set on the first table 133, these objects are sucked to the suction ports 150, so that the slippage of the objects to be sewn is effectively avoided during an automatic sewing operation.

INDUSTRIAL APPLICABILITY

When the sewing system and sewing method according to the present invention is used, the stitches to be sewn of a knitted fabric can be imaged automatically as described above by the operations of an image sensor, a storage means and a control means, so that it becomes possible to beautifully arrange stitch loops on a portion to be sewn, without carrying out a conventional step of capturing the stitches of a knitted fabric with naked eyes and engaging them one by one with locking needles, and attain a great increase in the efficiency of sewing work.

In the sewing system according to the present invention, a speed and an amount of movement of the sewing machine body and the timing of vertical movements of the sewing needle can be regulated freely. This renders it unnecessary to carry out a conventional step of replacing the sewing machine body every time the intervals of the stitches of a knitted fabric change, and enables knitted fabrics having stitches of any intervals to be sewn by one sewing machine body.

Moreover, when a lock stitch sewing machine body having a shuttle storing a bobbin thread is selected as the sewing machine body for even the sewing of a knitted fabric and a woven fabric, stitch loops of the knitted fabric can be beautifully arranged without causing fine wrinkles to occur on the woven fabric.

What is claimed is:

1. A sewing system comprising:

at least one table for placing objects to be sewn thereon;

a sewing machine body which has a sewing needle provided so that said sewing needle moves up and down freely, and a motor for moving said sewing needle up and down at an arbitrary speed, and which is adapted to sew the objects together;

an X–Y feed mechanism placed under said sewing machine for moving said sewing machine body relatively by a required amount in the direction parallel to a longitudinal axis of said table, and also move the same relatively by a required amount in the direction perpendicular to the longitudinal axis of said table;

an image sensor located near said sewing machine for fetching image data on the objects to be sewn;

a storage means for storing guide patterns for the objects to be sewn and indicative of portions to be sewn together and positions on said objects where said objects are to be sewn together; and a control means connected to said sewing machine, said storage means and image sensor for searching the image data for the shape of the guide patterns, for computing on the basis of the detected guide patterns first coordinates on which the portions to be sewn are positioned, and for computing a difference between the first coordinates and second coordinates on which said sewing needle of said sewing machine body is actually placed, for moving said sewing machine body by the difference in a required direction, and for giving instructions to said sewing machine to sew the portions indicated by the guide patterns.

2. A sewing system according to claim 1, wherein said table is provided with a fixing means comprising a fixing needle throat plate having a plurality of fixing needles placed on one side of said table through bores in said table; and a pressure member placed over the bores on the other side of said table and having a recess for receiving said fixing needles therein, wherein the objects to be sewn are fixed on an upper surface of said table by moving up said fixing needle throat plate so as to project said fixing needles from the upper surface of said table so that said fixing needles pierce through the objects to be sewn, and said pressure member is moved towards the upper surface of said table so as to receive said fixing needles in said recess and to press against upper surfaces of the objects to be sewn, and wherein the objects to be sewn are removed from said table by lowering said throat plate so as to retract said fixing needles from the upper surface of said table, and said pressure is moved away from the upper surface of said table so as to release an object from said fixing needles.

3. A sewing system according to claim 2, wherein said fixing needle throat plate is provided with alternate rows of said fixing needles of a comparatively large length and a comparatively small length.

4. A sewing system according to any one of claims 1~3, wherein said table is provided with a stretch-fixing means for fixing an expansible object to be sewn in a stretched state, and a stabilization means for preventing the fixed expansible object to be sewn from being dislocated during a sewing process.

5. A sewing system according to claim 4, wherein said stretch-fixing means comprises a stationary fixing member provided with locking needles to be engaged in one edge portion of the object to be sewn, and a movable fixing member provided with locking needles to be engaged in the other edge portion of the object to be sewn, said movable fixing member being movably disposed in an object stretching direction and being fixed in a required position.

6. A sewing system according to claim 5, wherein said stabilization means comprises a fixable plate detachably provided on the upper surface of said table and having a surface adhesiveness.

7. A sewing system according to claim 5, wherein said stabilization means comprises a plurality of suction ports formed in an upper wall of said table, and a suction unit joined to said suction ports so as to communicate therewith.

8. A sewing system according to any one of claims 5, 6 and 7, wherein said table is provided with a holding member for pressing the surface of the object to be sewn which has been stretched to a required length by said stretch-fixing means.

9. A sewing system according to any one of claims 1~3, wherein said table is provided on its upper surface with a member for measuring a length of the objects to be sewn.

10. A sewing system according to any one of claims 1~3, wherein said table comprises a first table member provided with said stretch-fixing means and said stabilization means, and a second table member provided with a fixing means formed of said fixing needle throat plate and said pressure member, a needle path through which said sewing needle of said sewing machine body passes being formed between said first and second table members.

11. A sewing system according to any one of claims 1~3, wherein a waste thread is knitted onto the surface of the knitted object to be sewn in such a manner that stitches of a predetermined shape are continuously arranged to form the guide patterns.

12. A sewing system according to any one of claims 1~3, wherein figures of predetermined shapes are displayed on said plate member which is disposed close to the surface of the object to be sewn, in such a manner that the figures are arranged at predetermined intervals to form the guide patterns.

13. A sewing system according to any one of claims 1~3, wherein said sewing machine body is provided with a shuttle having a tip and a bobbin thread stored in the interior thereof, said shuttle synchronously rotating with upward and downward movements of sad sewing needle capturing at said tip thereof a needle thread which has been carried thereto by said sewing needle, and forming lock stitches by connecting the bobbin thread to the needle thread.

14. A sewing system according to any one of claims 1~3, wherein said sewing machine body is provided with a tip-carrying looper, said looper being synchronously rotating with the upward and downward movements of said sewing needle, capturing at said tip thereof the sewing thread which said sewing needle has carried thereto and form loops, and passing the sewing thread which said sewing thread has subsequently carried thereto through the loops and forming a chain seam.

15. A sewing method comprising at least the steps of:

forming guide patterns indicative of stitches to be sewn; by knitting a waste thread onto a surface of a knitted fabric that is one object to be sewn, in such a manner that the stitches are continuously arranged in a predetermined shape;

placing on a surface of a table a second object to be sewn, and laminating the knitted fabric on the second object to be sewn;

fetching an image of the surface of the knitted fabric by using an image sensor;

setting the shape of the guide patterns that are to be detected on the basis of the image and a position of stitches that are to be sewn together on the basis of the guide patterns;

storing the shape and the position in a storage means;

scanning the surface of the knitted fabric by said image sensor and fetching corresponding image data sequentially;

searching the image data for the shape of the guide patterns stored in said storage means while sequentially computing coordinates on which the stitches to be sewn together are positioned on the basis of the detected guide patterns; and aligning a sewing needle of a sewing machine and the stitches with each other on the basis of the computed coordinates while sequentially executing the sewing of the stitches.

16. A sewing method, wherein a first knitted fabric, one object to be sewn and a second knitted fabric, the other object to be sewn are sewn together, comprising at least the steps of:

knitting waste threads onto surfaces of the first fabric and the second knitted fabric in such a manner that stitches are continuously arranged in a predetermined shape and thereby forming guide patterns indicative of stitches to be sewn;

placing the first knitted fabric on the surface of a table;

fetching an image of the surface of the first knitted fabric by using an image sensor;

setting a shape of the guide patterns to be detected on the basis of the image and a position of the stitch to be sewn on the basis of the guide pattern;

storing the shape and the position in a storage means;

scanning the surface of the first knitted fabric by said image sensor while sequentially fetching corresponding image data;

searching the image data for the shape of the guide pattern stored in said storage means and sequentially computing coordinates on which the stitches to be sewn are positioned on the basis of the detected guide pattern;

aligning a sewing needle of a sewing machine on the stitches to be sewn on the basis of the computed coordinates sewing of the stitches on a back tuck;

placing the second knitted fabric on the surface of the first knitted fabric;

scanning the surface of the second knitted fabric by the image sensor while fetching corresponding image data sequentially, searching the image data for the shape of the guide patterns stored in the storage means while sequentially computing the coordinates on which the stitches to be sewn are positioned on the basis of the position of the detected guide patterns; and aligning said sewing needle of said sewing machine on the stitches to be sewn while sequentially sewing the stitches.

17. A sewing method of sewing a portion of one object to be inserted between first and second end portions of a knitted fabric, the other object to be sewn, comprising the steps of:

knitting waste threads onto surfaces of the first and second end portions so that stitches are continuously arranged in a predetermined shape thereby forming guide patterns indicative of the stitches to be sewn;

placing on the surface of a table the object to be sewn and the first end portion on one surface of the object to be sewn, fetching an image of the surface of the first end portion by using an image sensor;

setting the shape of the guide patterns to be detected on the basis of the image and the position of the stitches to be sewn on the basis of the guide patterns;

storing the shape and the position in said storage means;

scanning the surface of the first end portion by said image sensor while fetching corresponding image data sequentially;

searching the image data for the shape of the guide patterns stored in said storage means while sequentially computing coordinates on which the stitches to be sewn are positioned on the basis of the position of the detected guide pattern;

aligning a sewing needle of a sewing machine on the stitches to be sewn on the basis of the computed coordinates and sewing the stitches;

reversing the first end portion and the object to be sewn and placing the second end portion on the other surface of the object to be sewn;

scanning the surface of the second end portion by said image sensor and sequentially fetching image data;

searching the image data for the shape of the guide patterns stored in said storage means while sequentially computing the coordinates on which the stitches to be sewn are positioned on the basis of the position of the detected guide patterns; and aligning said sewing needle of the sewing machine on the stitches to be sewn and sequentially sewing of the stitches.

18. A sewing method of sewing a portion of one object to be inserted between first and second end portions of a knitted fabric, the other object to be sewn, comprising the steps of:

knitting waste threads onto surfaces of the first and second end portions so that stitches are continuously arranged in a predetermined shape thereby forming guide patterns indicative of the stitches to be sewn;

placing the first end portion on the surface of a table;

fetching an image of the surface of the first end portion by using an image sensor;

setting the shape of the guide patterns to be detected on the basis of the image and the position of the stitches to be sewn on the basis of the guide patterns and storing the shape and the position in said storage means;

scanning the surface of the first end portion by the image sensor and fetching corresponding image data sequentially;

searching the image data for the shape of the guide patterns stored in said storage means while sequentially computing coordinates on which the stitches to be sewn are positioned on the basis of the position of the detected guide pattern;

aligning a sewing needle of a sewing machine on the stitches to be sewn on the basis of the computed coordinates and sequentially back tuck sewing the stitches;

reversing the first end portion and placing the the second end portion on the object to be sewn;

scanning the end surface of the second end portion by said image sensor and sequentially fetching image data;

searching the image data for the shape of the guide patterns stored in said storage means and sequentially computing the coordinates on which the stitches to be sewn are positioned on the basis of the position of the detected guide patterns; and aligning said sewing needle of the sewing machine on the stitches to be sewn on the basis of the computed coordinates and sequentially sewing the stitches.

19. A sewing method according to any one of claims 15~18, wherein said aligning said sewing needle of said sewing machine on the stitches to be sewn is done by moving at least one of said sewing needle of said sewing machine and the objects to be sewn in at least one of X-direction and Y-direction.

20. A sewing method according to any one of claims 15~18, wherein the waste thread is formed by impregnating a thread of a color different from that of the yarn constituting the knitted fabric with a predetermined resin, the resultant waste thread being knitted into the portion of the knitted fabric which is in the vicinity of the stitches to be sewn to form the guide patterns.

21. A sewing method according to any one of claims 15~18, wherein a waste thread formed by impregnating a thread with a predetermined resin and fluorescent paint so that the resultant waste thread that is distinguished from the yarn constituting the knitted fabric is knitted into the portion of the knitted fabric which is in the vicinity of the stitches to be sewn to form guide patterns, the guide patterns being irradiated with black light.

22. A sewing method according to any one of claims 15~18, wherein the waste threads are removed after the completion of a sewing operation.

23. A sewing method according to any one of claims 15~18, wherein, when the knitted fabric comprises a garment knitted portion having a stitch pattern proper to a knitted product, and a waste knitted portion knitted continuously with the garment knitted portion, the waste thread being knitted into the section of the waste knitted portion which is close to the section thereof which borders on the garment knitted portion to form guide patterns indicative of the stitches to be sewn, the waste knitted portion being removed after the completion of the sewing operation.

24. A sewing method according to any one of claims 15~18, wherein the guide patterns are formed by plain knitting a waste thread comprising chemical fiber and natural fiber.

25. A sewing method according to any one of claims 15~18, wherein the objects to be sewn are fixed by engaging at least a part of the objects to be sewn with a plurality of fixing needles.

26. A sewing method according to claim 25, wherein, when a sewing line of the objects to be sewn is divided into a plurality of sections due to the existence of a curved section, a plurality of fixing needles, which are arranged at predetermined intervals, is divided into a plurality of groups each of which has a predetermined number of fixing needles that corresponds to the curvature and length of each of the sections of the objects to be sewn, by setting a plurality of marks at predetermined intervals, each of the sections of the objects to be sewn being engaged with the fixing needles belonging to its corresponding group when the sewing line of the objects to be sewn is engaged with said fixing needles.

* * * * *